US009200337B2

(12) United States Patent
Colakyan et al.

(10) Patent No.: US 9,200,337 B2
(45) Date of Patent: Dec. 1, 2015

(54) METHOD FOR MIXED BIOMASS HYDROLYSIS

(71) Applicant: Renmatix, Inc., King of Prussia, PA (US)

(72) Inventors: Manuk Colakyan, Ardmore, PA (US); Rory Hernan Jara-Moreno, Wayne, PA (US)

(73) Assignee: Renmatix, Inc., King of Prussia, PA (US)

( * ) Notice: Subject to any disclaimer, the term of this patent is extended or adjusted under 35 U.S.C. 154(b) by 31 days.

(21) Appl. No.: 14/258,362

(22) Filed: Apr. 22, 2014

(65) Prior Publication Data

US 2015/0299816 A1 Oct. 22, 2015

(51) Int. Cl.
*C13K 13/00* (2006.01)

(52) U.S. Cl.
CPC ..... *C13K 13/002* (2013.01)

(58) Field of Classification Search
None
See application file for complete search history.

(56) References Cited

U.S. PATENT DOCUMENTS

| | | | | |
|---|---|---|---|---|
| 8,057,639 | B2 | 11/2011 | Pschorn | 162/232 |
| 2009/0053771 | A1 | 2/2009 | Dale | 435/72 |
| 2011/0065159 | A1 | 3/2011 | Raines et al. | 435/163 |
| 2012/0193046 | A1 | 8/2012 | Varanasi et al. | 162/9 |
| 2013/0042859 | A1 | 2/2013 | Geremia et al. | 127/44 |
| 2013/0303742 | A1* | 11/2013 | Sutterlin et al. | 536/18.6 |
| 2014/0014092 | A1* | 1/2014 | Kazachkin et al. | 127/30 |
| 2015/0122245 | A1* | 5/2015 | Johannesson et al. | 127/37 |

FOREIGN PATENT DOCUMENTS

| | | |
|---|---|---|
| NZ | 629049 | 4/2014 |
| UY | 36.018 | 4/2014 |
| WO | WO 2014/026154 A1 | 2/2014 |
| WO | PCT/US2014/034902 | 4/2014 |

OTHER PUBLICATIONS

Brodeur-Campbell M, et al. (2012) Feedstock mixture effects on sugar monomer recovery following dilute acid pretreatment and enzymatic hydrolysis. Bioresource Technology, 116: 320-326.

Chen R, et al. (1996) Kinetic and modeling investigation on two-stage reverse-flow reactor as applied to dilute-acid pretreatment of agricultural residues. Applied Biochemistry and Biotechnology, 57/58: 133-146.

Converse AO, et al. (1989) Kinetics of thermochemical pretreatment of lignocellulosic materials. Applied Biochemistry and Biotechnology, 20/21: 63-78.

Iranmahboob J, et al. (2002) Optimizing acid-hydrolysis: A critical step for production of ethanol from mixed wood chips. Biomass and Bioenergy, 22(5): 401-404.

Jensen J, et al. (2008) Kinetic characterization of biomass dilute sulfuric acid hydrolysis: Mixtures of hardwoods, softwood, and switchgrass. Amer. Inst. Chem. Engrs. 54(6): 1637-1645.

Levenspiel O. (2002) The Chemical Reactor Omnibook. Oregon State University Bookstores, Inc. Chapters 22-23.

Yat SC, et al. (2008) Kinetic characterization for dilute sulfuric acid hydrolysis of timber varieties and switchgrass. Bioresource Technology, 99: 3855-3863.

Brodeur, G. et al., "Chemical and physicochemical pretreatment of lignocellulosic biomass: a review", Enzyme Research, 2011, 2011, pp. 1-17.

International Search Report and Written Opinion mailed Jan. 13, 2015 for Application No. PCT/US2014/034902., which was filed Apr. 22, 2014. (First Named Inventor—Colakyan//Applicant—Renmatix//(10 pages).

* cited by examiner

*Primary Examiner* — Melvin C Mayes
*Assistant Examiner* — Douglas Call
(74) *Attorney, Agent, or Firm* — Travis B Gasa; Ballard Spahr LLP

(57) ABSTRACT

Methods and systems are disclosed for the hydrolysis of mixed biomass. The methods include forming a mixture of at least two modified biomass feedstocks to achieve various benefits, such as maximizing sugar yields and minimizing the formation of degradation products.

20 Claims, 10 Drawing Sheets

METHOD FOR MIXED BIOMASS HYDROLYSIS

FIELD OF THE INVENTION

The present invention generally relates to methods for biomass hydrolysis. More particularly, it relates to methods for hydrolysis of mixed modified biomass feedstocks that provide various benefits, such as maximizing sugar yields and minimizing the formation of degradation products, for example, derived from the degradation of sugars.

BACKGROUND OF THE INVENTION

There has been increasing interest in converting cellulosic biomass to fuels or other chemicals. There are many biomass conversion processes, including acid hydrolysis, enzymatic hydrolysis, and gasification. One biomass conversion process gaining traction is hydrothermal treatment, which typically includes a first step of contacting a biomass with hot compressed water, with or without an acid catalyst. This step typically enables the extraction and hydrolysis of hemicellulosic sugars and, in under certain conditions, the hydrolysis of cellulose to sugars. Depending on the time and temperature of the treatment, and the catalyst loading (if used), the hemicellulosic sugars are either partially or completely extracted. Subsequent steps may include further treatment of the remaining unconverted biomass (e.g., cellulose), as well as transformation of the extracted sugars from the first step into ethanol or other useful chemicals.

In the first step of this process, hemicellulose typically is converted to monomeric and oligomeric sugars, such as xylose, xylo-oligosaccharides, rhamnose, arabinose, galactose, and mannose. The ratio of oligomers-to-monomers varies depending on the severity of the reaction (e.g., the time, pressure and temperature history, and the catalyst amount, if used). The reaction also generates by-products and/or degradation products, such as acetic acid, furfural, hydroxylmethyl furfural (HMF), and organic acids, such as formic acid and levulinic acid.

In the pulp and paper industry, biomass processing methods are designed to extract the hemicellulose and most of the lignin from the lignocellulosic biomass by the addition of chemicals (e.g., using the Kraft process or sulfite process), leaving most of the cellulose behind. Typically no measures are taken to maximize the yield of sugars extracted (e.g., xylose and/or xylo-oligosaccharides), because the focus of these technologies is on producing cellulose for making paper or paper products. Moreover, many processes employ chemicals to facilitate the extraction or recovery of cellulose, but these processes are more expensive than those that do not employ chemicals. Even in situations where it may be desirable to maximize the extraction yield of hemicellulosic sugars, such methods are only optimized for one biomass feedstock.

In order to sustain large production rates of sugars derived from biomass and the subsequent ethanol production, it may be necessary to mix different biomasses for processing. Utilizing mixtures of different biomasses for processing presents a significant challenge for conversion to sugars, especially for hemicelluloses extraction. Different biomasses hydrolyze at different rates, and the hydrolysis rate may depend on a variety of factors. If mixtures of biomass are hydrolyzed without accounting for the large variability in hydrolysis rates of the component biomasses in the mixture, the sugar yields will be lower than the potential maximum yields, and the production of degradation products typically will be increased.

Thus, there is an ongoing need for methods for maximizing sugar yields from mixtures of biomass. The methods of the present invention are directed toward these, as well as other, important ends.

It will be appreciated that this background description has been created by the inventors to aid the reader and is not to be taken as an indication that any of the indicated problems were themselves appreciated in the art. While the described principles can, in some aspects and embodiments, alleviate the problems inherent in other systems, it will be appreciated that the scope of the protected innovation is defined by the attached claims and not by the ability of any disclosed feature to solve any specific problem noted herein.

SUMMARY OF THE INVENTION

In one embodiment, the invention relates to a hydrolysis method comprising, consisting of, or consisting essentially of:

(1) providing at least two modified biomass feedstocks comprising:
  (a) from greater than 0 wt % to less than 100 wt % of a first modified biomass feedstock exhibiting a maximum hydrolysis yield at time X, when subjected to a first condition; and
  (b) from greater than 0 wt % to less than 100 wt % of a second modified biomass feedstock exhibiting a maximum hydrolysis yield at time Y, when subjected to the first condition;
  wherein:
  the second modified biomass feedstock is different from the first modified biomass feedstock;
  time X is less than or equal to time Y;
  and time X and time Y differ by less than or equal to about 100% of time X; and
(2) subjecting a mixture of the first modified biomass feedstock and the second modified biomass feedstock to the first condition to achieve a maximum hydrolysis yield at time Z, wherein time Z is less than time Y;
wherein:
the hydrolysis method is performed at a pH of at least 1.3; and
all weight percent values are on a dry basis and are based on the total weight of the at least two modified biomass feedstocks.

In another embodiment, the second modified biomass feedstock is different from the first modified biomass feedstock by a difference selected from the group consisting of compositional proportions, biomass type, biomass species, hemicellulose structure, geographical harvesting location, harvesting season, and any combination thereof.

In a further embodiment, the first modified biomass feedstock is prepared by a first treatment, and the second modified biomass feedstock is prepared by a second treatment. The first and second treatments may be independently selected from the group consisting of size reduction, steam explosion, enzymatic treatment, acid treatment, base treatment, hydrothermal treatment, biological treatment, catalytic treatment, non-catalytic treatment, and any combination thereof. The first treatment may be the same or different than the second treatment.

In yet another embodiment, a first degradation yield of a degradation product at time Z achieved in subjecting the mixture to the first condition is lower than at least one of (i) a second degradation yield of the degradation product of the first modified biomass feedstock at time X, when subjected to the first condition, and (ii) a third degradation yield of the degradation product of the second modified biomass feedstock at time Y, when subjected to the first condition.

While aspects of the present invention can be described and claimed in a particular statutory class, such as the system statutory class, this is for convenience only and one of skill in the art will understand that each aspect of the present invention can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way intended that an order be inferred, in any respect. This holds for any possible non-express basis for interpretation, including matters of logic with respect to arrangement of steps or operational flow, plain meaning derived from grammatical organization or punctuation, or the number or type of embodiments described in the specification. It is to be understood that both the foregoing general description and the following detailed description are exemplary and explanatory only and are not restrictive.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE INVENTION

Figure 1:
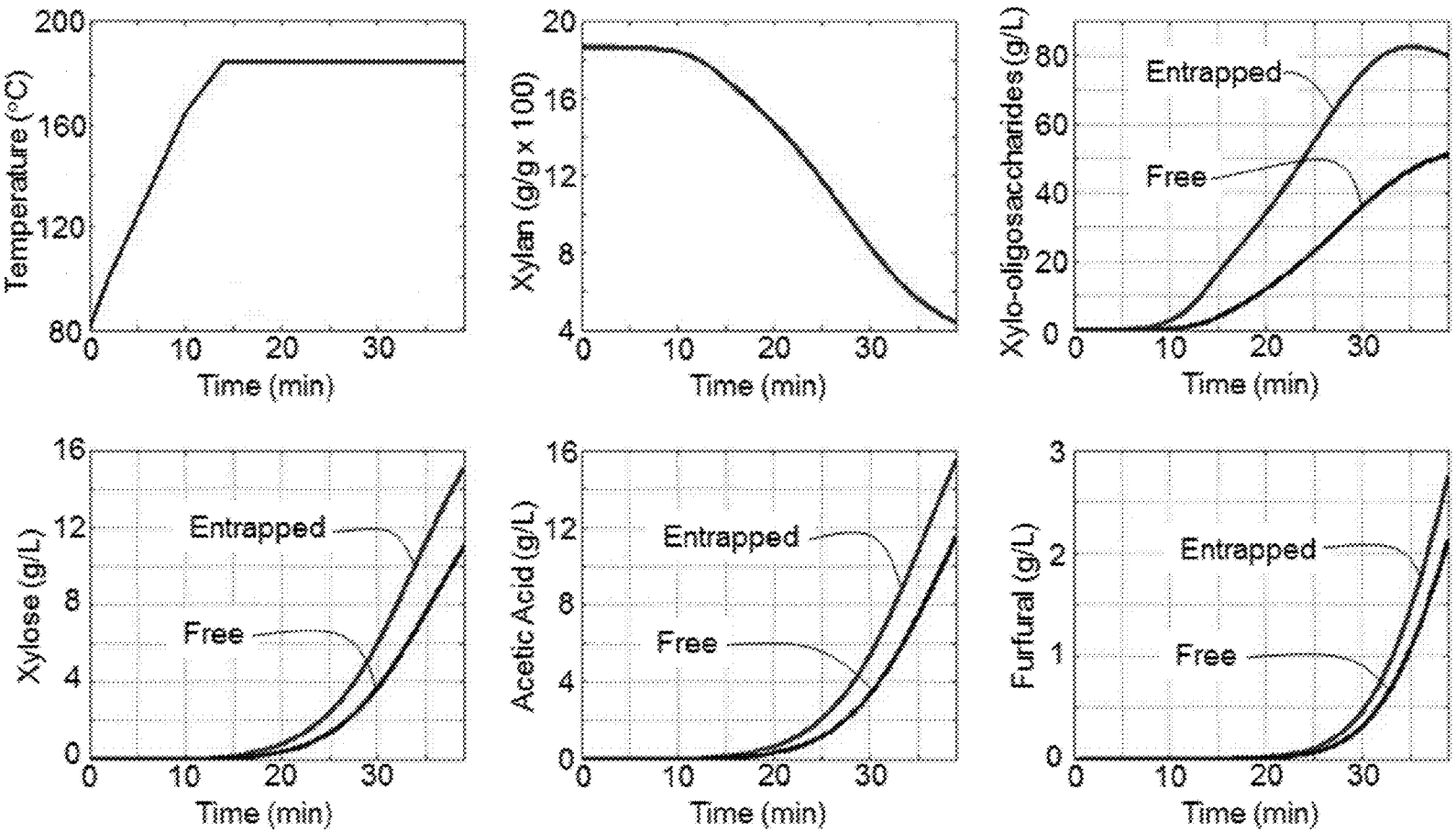
FIG. 1 shows the simulated results of a biomass hydrolysis experiment in Example 1.

The present invention can be understood more readily by reference to the following detailed description, examples, drawings, and claims, and their previous and following description. However, it is to be understood that this invention is not limited to the specific compositions, articles, devices, systems, and/or methods disclosed unless otherwise specified, and as such, of course, can vary. It is also to be understood that the terminology used herein is for the purpose of describing particular aspects only and is not intended to be limiting.

The following description of the invention is also provided as an enabling teaching of the invention in its best, currently known aspect. To this end, those of ordinary skill in the relevant art will recognize and appreciate that changes and modifications may be made to the various aspects of the invention described herein, while still obtaining the beneficial results of the present invention. It will also be apparent that some of the benefits of the present invention may be obtained by selecting some of the features of the present invention without utilizing other features. Accordingly, those of ordinary skill in the relevant art will recognize that many modifications and adaptations to the present invention are possible and may even be desirable in certain circumstances and are thus also a part of the present invention. Thus, the following description is provided as illustrative of the principles of the present invention and not in limitation thereof.

Any combination of the elements described herein in all possible variations thereof is encompassed by the invention unless otherwise indicated herein or otherwise clearly contradicted by context.

Moreover, it is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

All publications mentioned herein are incorporated herein by reference to disclose and describe the methods and/or materials in connection with which the publications are cited.

It is to be understood that the terminology used herein is for the purpose of describing particular aspects only and is not intended to be limiting. As used in the specification and in the claims, the term "comprising" may include the aspects "consisting of" and "consisting essentially of" Unless defined otherwise, all technical and scientific terms used herein have the same meaning as commonly understood by one of ordinary skill in the art to which this invention belongs. In this specification and in the claims which follow, reference will be made to a number of terms which shall be defined herein.

As used in the specification and the appended claims, the singular forms "a," "an" and "the" include plural referents unless the context clearly dictates otherwise.

As used herein, the terms "optional" or "optionally" mean that the subsequently described event, condition, component, or circumstance may or may not occur, and that the description includes instances where said event or circumstance occurs and instances where it does not.

As used herein, the term or phrase "effective," "effective amount," or "conditions effective to" refers to such amount or condition that is capable of performing the function or property for which an effective amount is expressed. As will be pointed out below, the exact amount or particular condition required may vary from one aspect to another, depending on recognized variables such as the materials employed and the processing conditions observed. Thus, it is not always possible to specify an exact "effective amount" or "condition effective to."

References in the specification and concluding claims to parts by weight, of a particular element or component in a composition or article denotes the weight relationship between the element or component and any other elements or components in the composition or article for which a part by weight is expressed. Thus, in a composition containing 2 parts by weight of component X and 5 parts by weight component Y, X and Y are present at a weight ratio of 2:5, and are present in such ratio regardless of whether additional components are contained in the composition.

A weight percent of a component, unless specifically stated to the contrary, is based on the total weight of the formulation or composition in which the component is included. For example if a particular element or component in a composition or article is said to have 8% weight, it is understood that this percentage is relation to a total compositional percentage of 100%.

While the present invention is capable of being embodied in various forms, the description below of several embodiments is made with the understanding that the present disclosure is to be considered as an exemplification of the invention, and is not intended to limit the invention to the specific embodiments illustrated. Headings are provided for convenience only and are not to be construed to limit the invention in any manner. Embodiments illustrated under any heading may be combined with embodiments illustrated under any other heading.

As used herein, the term "biomass" means a renewable energy source generally comprising carbon-based biological material derived from living or recently-living organisms. Suitable feedstocks include lignocellulosic feedstock, cellulosic feedstock, hemicellulosic feedstock, starch-containing feedstocks, etc. The lignocellulosic feedstock can be from any lignocellulosic biomass, such as plants (e.g., duckweed, annual fibers, etc.), trees (softwood, e.g., fir, pine, spruce, etc.; tropical wood, e.g., balsa, iroko, teak, etc.; or hardwood, e.g., elm, oak, aspen, pine, poplar, willow, *eucalyptus*, etc.), bushes, grass (e.g., *miscanthus*, switchgrass, rye, reed canary grass, giant reed, or sorghum), dedicated energy crops, municipal waste (e.g., municipal solid waste), and/or a by-product of an agricultural product (e.g., corn, sugarcane, sugar beets, pearl millet, grapes, rice, straw). The biomass can be from a virgin source (e.g., a forest, woodland, or farm) and/or a by-product of a processed source (e.g., off-cuts, bark, and/or sawdust from a paper mill or saw mill, sugarcane bagasse, corn stover, palm oil industry residues, branches, leaves, roots, and/or hemp). Suitable feedstocks may also include the constituent parts of any of the aforementioned feedstocks, including, without limitation, lignin, C6 saccharides (including cellulose, cellobiose, C6 oligosaccharides, and C6 monosaccharides), C5 saccharides (including hemicellulose, C5 oligosaccharides, and C5 monosaccharides), and mixtures thereof.

As used herein, "dry biomass" (or equivalently "bone dry biomass") refers to biomass without any water (i.e., about 0% moisture content). Dry biomass is typically referred to in the context of the weight ratio of water to dry biomass.

As used herein, the term "modified biomass" refers to a biomass that has been subjected to a treatment prior to a subsequent use (e.g., hydrolysis). In some embodiments the modified biomass is subjected to a treatment, for example, and without any limitations, a mechanical treatment, a chemical treatment, a biological treatment, a heat treatment, or any combination thereof. In some embodiments the treatment includes, but is not limited to, size reduction, steam explosion, liquid hot water, pH controlled hot water, flow-through liquid hot water, dilute acid, strong acid, flow-through acid, ammonia fiber/freeze explosion, ammonia recycled percolation, alkali swelling, enzymatic treatment, acid treatment, base treatment, hydrothermal treatments, or any combination thereof. The treatment can comprise one treatment, or the treatment can comprise more than one treatment, e.g., two, three, four, five, six, or seven treatments, which can be the same or different from one another. The treatments are further described elsewhere herein.

As used herein, the term "different biomass feedstocks" refers to biomass feedstocks that may be differentiated on a basis of, e.g., at least one of compositional proportions, biomass type, biomass species, biomass size, hemicellulose structure, geographical harvesting location, and harvesting season. In one embodiment, one biomass feedstock is different from another biomass feedstock by way of being different biomass types. In another embodiment, one biomass feedstock is different from another biomass feedstock by way of being different biomass species. In yet another embodiment, two biomass feedstocks may be considered to be different if the two feedstocks are the same biomass species, but have been harvested at different geographical locations (e.g., at least 30 miles apart). In one embodiment, two biomass feedstocks may be considered to be different if the two feedstocks are harvested from a different geographical location and have a different hemicellulose structure.

As used herein, "compositional proportions" of biomass means the proportions of cellulose, lignin, hemicellulose, sugars, ash, extractives, and protein, if present, in a given biomass.

As used herein, "biomass type" means the type of biomass, i.e., whether the biomass is softwood, hardwood, annual fiber, non-woody biomass, or municipal waste (e.g., municipal solid waste).

As used herein, "biomass species" means the species of biomass. In certain embodiments, two biomasses may be considered to be different biomass species if at least one of the biomasses is genetically modified. If both biomasses are genetically modified, then the genetic modifications typically will be different in order to consider the two biomass species to be different.

As used herein, "hemicellulose structure" means the structure of the hemicellulose polysaccharide(s) contained with a given biomass. The structure can be defined, for example, in terms of the compositional proportions of monosaccharides present in the hemicellulose, and/or as the types, extent, and locations of bonding present in the hemicellulose (e.g., branching, linearity, types and locations of sugar linkages such as $\beta(1,4)$, $\alpha(1,4)$, $\beta(1,3)$, $\alpha(1,3)$, etc.).

As used herein, "geographical harvesting location" means the location where the biomass has been harvested (e.g., cut down, pulled from the ground, trimmed from the growing plant or tree, etc.).

As used herein, "harvesting season" means the time of year that the biomass is harvested (e.g., cut down, pulled from the ground, trimmed from the growing plant or tree, etc.). The harvesting seasons include spring, summer, fall, and winter, or the first quarter, second quarter, third quarter, or fourth quarter of a year, or same harvesting season but separated by a period of at least one year.

As used herein, the term "woody biomass" refers to a biomass type that includes hardwoods, softwoods, and/or tropical woods. Woody biomass typically includes, for example, logs, whole-tree chips, bole chips, mill chips, bark chips, woody crops (e.g., hybrid poplar, hybrid willow, etc.), and materials derived from hardwoods and softwoods, including sawdust, sawmill residues, construction wastes, pulp waste, municipal waste, etc. In one embodiment and without limitations, the woody biomass may come from manufacturing residues, timber harvest resides, post-consumer wood waste, or urban and agricultural wood waste, or any combination thereof.

As used herein, the term "non-woody biomass" refers to a biomass type that is not a hardwood, softwood, and/or tropical wood. Non-woody biomass typically includes, for example, perennial lignocellulosic crops (e.g., switchgrass), agricultural residues (e.g., corn stover, sugarcane bagasse, etc.), polysaccharides (e.g., grains, starch, etc.), oils (e.g., soybeans). In some embodiments and without limitations, the non-woody biomass includes agricultural crops, crop residues, processing residues (e.g., residues resulting from processing a non-woody biomass, including fruit processing residues, food processing residues, corn stover, sugar cane bagasse, etc.), animal waste, or any combination thereof.

As used herein, the term "municipal waste" is a biomass type that typically is a mixture of components, or is derived from a mixture of components. Typically, municipal waste is trash (i.e., garbage or refuse), or a component thereof. Municipal waste can be solid, liquid, or a combination thereof. Municipal waste typically includes waste from residential (household waste), commercial, institutional, agricultural, and/or industrial sources, including, for example and without limitation, biodegradable waste, non-biodegradable waste, paper mill discards, sawmill discards, construction waste, cardboards, recycled paper, fabrics, leather, food waste and residues, yard waste, a wide variety of plastics, including bio-based plastics, packaging, and carpeting. Examples of industrial waste and residues include, but are not limited to, waste and residues from the construction industry, textile industry, food industry, petrochemical industry, carpeting industry, plastic industry, paper industry, pharmaceutical industry, hospitality industry, and like. Examples of agricultural waste include, but are not limited to, crops waste, food waste, and animal waste. Municipal waste typically is shredded or ground trash after collection, which facilitates sorting and/or handling. The shredded or ground municipal waste can be substantially sorted into its constituent components, if desired, including metals, plastics, and cellulosic materials. As used herein, "municipal waste" is whole trash, or trash that has been shredded or ground, including sorted and unsorted versions thereof. In a preferred embodiment, municipal waste is the cellulosic component of the shredded trash. While municipal waste may include some components of other biomass types, as defined herein (e.g., softwood or hardwood), the municipal waste biomass type, as used herein, only includes municipal waste that is trash or is derived from trash (e.g., that is, or is derived from, a mixture of dissimilar materials, such as metals, plastic, banana peels, chicken bones, etc.). In this respect, certain types of "pure" construction waste, such as saw dust or discarded 2×4s, is not considered to be "trash" as used herein, because this construction waste, which may contain only hardwood material, was not derived from "trash" as used herein (i.e., a dissimilar mixture of materials, such as chicken bones, banana peels, tissue paper, etc.).

As used herein, "oligosaccharide" refers to linear or branched carbohydrate molecules of the same or different monosaccharide units joined together by glycosidic bonds. Oligosaccharides, as defined herein, are composed of about 2 to about 30 monosaccharide units. Polysaccharides, as defined herein, are composed of at least about 31 monosaccharide units.

As used herein, "monosaccharide" refers to any of the class of sugars that cannot be hydrolyzed to give a simpler sugar. Monosaccharides typically are $C_5$ (e.g., xylose) and $C_6$ sugars (e.g., glucose), but may also include monosaccharides having other numbers of carbon, such as $C_2$, $C_3$, $C_4$, $C_7$, $C_8$, and so on. Monosaccharides can be either in open-chain form or cyclic form.

As used herein, "hemicellulose" refers to a group of cell wall polysaccharides that have a β-(1→4)-linked structure with an equatorial configuration. Hemicelluloses include xyloglucans, xylans, mannans and glucomannans, and β-(1→3, 1→4)-glucans. The main components of hemicellulose typically are xylan (e.g., polymers of xylose) and glucomannan.

As used herein, "continuous" indicates a process that is uninterrupted for its duration, or interrupted, paused or suspended only momentarily relative to the duration of the process. Treatment of biomass is "continuous" when biomass is fed into the apparatus without interruption or without a substantial interruption, or processing of said biomass is not done in a batch process.

As used herein, "batch" indicates a process that is carried out in one or more stages. For example, a batch process that employs a batch reactor (e.g., a batch vessel or batch digester) can be carried out in a stage, where various components are charged to the vessel in a batchwise manner, and then substantially no material is added or removed from the vessel throughout the cycle (e.g., heating or washing).

As used herein, "total xylose" or "xylose equivalent" means the mass of xylan and/or xylo-oligosaccharides (XOS), as context will dictate, expressed as its equivalent mass as xylose. In other words, the "total xylose" or "xylose equivalent" is the mass of xylose that would result from hydrolyzing xylan and/or XOS, which accounts for the mass added from the addition of water in the hydrolysis.

The yield of sugars can be defined in the following fashion:

$$\text{yield} = \frac{\text{mass of sugar monomer} + \text{mass of sugar oligomer}}{\text{equivalent mass of total sugars in biomass}} \times 100 \quad (1)$$

And, as an example more specifically for xylose (the major component of hemicellulose):

$$\text{yield}_{xylose} = \frac{\text{mass of xylose monomer}(C5) + \text{mass of xylose oligomers}(C5)}{\text{mass of total xylan in biomass} \times 1.13} \times 100 \quad (2)$$

As used herein, the yield of a species of interest is calculated using the species present in the bulk liquor and the yield does not encompass any species present (i.e., "trapped") within the pores of a biomass. For example, with respect to equation (2) above, the mass of xylose monomer and mass of xylose oligomer includes only those species present in the bulk liquor, but does not include any xylose monomer or xylose oligomer present (i.e, "trapped") within the pores of the biomass.

The xylan conversion is calculated by using conventional techniques known in the art. For example, xylan conversion typically is calculated by subtracting the amount of xylan remaining after hydrolysis from the starting amount of xylan before hydrolysis, and dividing the result by the starting amount of xylan before hydrolysis.

As used herein, the term "substantially free of" refers to a composition having less than about 1% by weight, preferably less than about 0.5% by weight, and more preferably less than about 0.1% by weight, based on the total weight of the composition, of the stated material.

As used herein, "biological treatment" refers to a treatment comprising exposing a biomass to an environment comprising a living organism or a virus capable of modifying the biomass. For example and without limitations, the biological treatment may comprise composting and anaerobic treatment. In one embodiment, the biological treatment comprises exposure to fungi, or any other wood destroying organism. In another embodiment, the wood destroying organism may comprise one or more of termites, carpenter ants, moisture ants, beetles, bacteria, or any combination thereof.

A supercritical fluid is a fluid at a temperature above its critical temperature and at a pressure above its critical pressure. A supercritical fluid exists at or above its "critical point," the point of highest temperature and pressure at which the liquid and vapor (gas) phases can exist in equilibrium with one another. Above critical pressure and critical temperature, the distinction between liquid and gas phases disappears. A supercritical fluid possesses approximately the penetration properties of a gas simultaneously with the solvent properties of a liquid. Accordingly, supercritical fluid extraction has the benefit of high penetrability and good solvation.

Reported critical temperatures and pressures include: for pure water, a critical temperature of about 374.2° C., and a critical pressure of about 221 bar; for carbon dioxide, a critical temperature of about 31° C. and a critical pressure of about 72.9 atmospheres (about 1072 psig). Near-critical water has a temperature at or above about 300° C. and below the critical temperature of water (374.2° C.), and a pressure high enough to ensure that all fluid is in the liquid phase. Sub-critical water has a temperature of less than about 300° C. and a pressure high enough to ensure that all fluid is in the liquid phase. Sub-critical water temperature may be greater than about 250° C. and less than about 300° C., and in many instances sub-critical water has a temperature between about 250° C. and about 280° C. The term "hot compressed water" is used interchangeably herein for water that is at or above its critical state, or defined herein as near-critical or sub-critical, or any other temperature above about 50° C. (preferably, at least about 100° C., above about 150° C., or above about 200° C.) but less than subcritical, and at pressures such that water is in a liquid state.

As used herein, a fluid which is "supercritical" (e.g. supercritical water, supercritical $CO_2$, etc.) indicates a fluid which would be supercritical if present in pure form under a given set of temperature and pressure conditions. For example, "supercritical water" indicates water present at a temperature of at least about 374.2° C. and a pressure of at least about 221 bar, whether the water is pure water, or present as a mixture (e.g. water and ethanol, water and $CO_2$, etc.). Thus, for example, "a mixture of sub-critical water and supercritical carbon dioxide" indicates a mixture of water and carbon dioxide at a temperature and pressure above that of the critical point for carbon dioxide but below the critical point for water, regardless of whether the supercritical phase contains water and regardless of whether the water phase contains any carbon dioxide. For example, a mixture of sub-critical water and supercritical $CO_2$ may have a temperature of about 250° C. to about 280° C. and a pressure of at least about 225 bar.

As used herein, the term "equivalent spherical particle diameter" is a way to express the volume of a biomass chip or particle in terms of the diameter of a sphere encompassing the same volume. Specifically, "equivalent spherical particle diameter" is the diameter of a sphere that encompasses the same volume as a given irregularly shaped biomass particle or chip. For example, for a cube-shaped biomass particle having dimensions of A×B×C inches and occupying a volume of A*B*C $in^3$, the equivalent spherical diameter is $$2\sqrt[3]{\frac{3ABC}{4\pi}}$$

inches (i.e., the diameter of a sphere having the volume of ABC $in^3$).

As used herein, the terms "apparent rate" or "observed rate" are used interchangeably and refer to the rate of formation or disappearance of species which are observed during the reaction. In one embodiment, the terms "apparent rate" or "observed rate" may refer to a measure of the combined diffusion and reaction rates.

As used herein, "intrinsic reaction rate" is the rate of reaction calculated or measured in the absence of diffusion or any other phenomenon that would contribute to the apparent rate. In this context, the intrinsic reaction rate is calculated or measured using the bulk liquor concentrations of reactants and products.

As used herein, the terms "time X," "time Y," and "time Z," refer to the time that has lapsed over an identified period during biomass hydrolysis. In the context of maximum hydrolysis yield, the term "maximum hydrolysis yield at time X (or time Y, or time Z)" refers to the period of time required from the start of a hydrolysis process to reach a maximum hydrolysis yield for one or more sugars when hydrolyzing a specific modified biomass feedstock or combination of biomass feedstocks. Typically, "time X" (or "time Y" or "time Z") does not include any time required to bring the reaction mixture up to hydrolysis temperature. For example, the time period required to heat a mixture from room temperature (e.g., about 20° C.) to extraction temperature (e.g., about 165° C.) at a rate of about 4° C./min is not included in time X or time Y or time Z. In such cases, time zero in the measurement of time X (or time Y or Z) is the point at which a temperature of about 165° C. is reached. In some embodiments, time zero in the measurement of time X (or time Y or time Z) can be when a certain threshold temperature is first reached (e.g., a threshold temperature of about 135° C., about 140° C., about 145° C., about 150° C., about 155° C., about 160° C., about 165° C., about 170° C., about 175° C., about 180° C., about 185° C., about 190° C., about 195° C., about 200° C., about 205° C., about 210° C., about 215° C., about 220° C., about 225° C., about 230° C., about 235° C., about 240° C., about 245° C., about 250° C., about 255° C., about 260° C., about 265° C., about 270° C., about 275° C., about 280° C., about 285° C., about 290° C., about 295° C., or about 300° C.). In some embodiments, where hydrolysis occurs in two or more steps and the temperature is reduced below a threshold temperature between steps, then time X or time Y or time Z is the total time that the reaction mixture is above the threshold temperature but does not include the time below the threshold temperature. In some embodiments, time zero in the measurement of time X (or time Y or time Z) can be the time at which a species of interest is first detected using the sugar analysis techniques described herein. Time X or time Y or time Z can refer, for example, to the residence time above a threshold temperature in a digester, or, for example, can refer to the residence time above a threshold temperature in a flow-through reactor.

As used herein, the term "degradation yield" refers to the yield of a degradation product. In some embodiments, degradation products include, without limitation, furfural, hydroxylmethyl furfural (HMF), and organic acids, such as formic acid, levulinic acid, and/or lactic acid. In a preferred embodiment, "degradation yield" refers to the yield of furfural.

The use of numerical values in the various quantitative values specified in this application, unless expressly indicated otherwise, are stated as approximations as though the minimum and maximum values within the stated ranges were both preceded by the word "about." In this manner, slight variations from a stated value may be used to achieve substantially the same results as the stated value. Also, the disclosure of ranges is intended as a continuous range including every value between the minimum and maximum values recited as well as any ranges that may be formed by such values. Also disclosed herein are any and all ratios (and ranges of any such ratios) that can be formed by dividing a recited numeric value into any other recited numeric value. Accordingly, the skilled person will appreciate that many such ratios, ranges, and ranges of ratios can be unambiguously derived from the numerical values presented herein and in all instances such ratios, ranges, and ranges of ratios represent various embodiments of the present invention.

While the present invention is capable of being embodied in various forms, the description below of several embodiments is made with the understanding that the present disclosure is to be considered as an exemplification of the invention, and is not intended to limit the invention to the specific embodiments illustrated. Headings are provided for convenience only and are not to be construed to limit the invention in any manner. Embodiments illustrated under any heading or in any paragraph may be combined with embodiments illustrated under any other heading or paragraph.

In one embodiment, the invention is directed to a hydrolysis method comprising:

(1) providing at least two modified biomass feedstocks comprising:
  (a) from greater than 0 wt % to less than 100 wt % of a first modified biomass feedstock exhibiting a maximum hydrolysis yield at time X, when subjected to a first condition; and
  (b) from greater than 0 wt % to less than 100 wt % of a second modified biomass feedstock exhibiting a maximum hydrolysis yield at time Y, when subjected to the first condition;
  wherein:
  the second modified biomass feedstock is different from the first modified biomass feedstock;
  time X is less than or equal to time Y;
  and time X and time Y differ by less than or equal to about 100% of time X; and
(2) subjecting a mixture of the first modified biomass feedstock and the second modified biomass feedstock to the first condition to achieve a maximum hydrolysis yield at time Z, wherein time Z is less than time Y;

wherein:

the hydrolysis method is performed at a pH of at least 1.3; and all weight percent values are on a dry basis and are based on the total weight of the at least two modified biomass feedstocks.

In some embodiments, the first modified biomass feedstock exhibiting a maximum hydrolysis yield at time X when subjected to a first condition may be present in the mixture of the at least two modified biomass feedstocks in any amount from greater than 0 wt % to less than 100 wt %, including exemplary amounts of at least about 1 wt. %, e.g., at least about 5 wt. %, at least about 10 wt. %, at least about 15 wt. %, at least about 20 wt. %, at least about 25 wt. %, at least about 30 wt. %, at least about 35 wt. %, at least about 40 wt. %, at least about 45 wt. %, at least about 50 wt. %, at least about 55 wt. %, at least about 60 wt. %, at least about 65 wt. %, at least about 70 wt. %, at least about 75 wt. %, at least about 80 wt. %, at least about 85 wt. %, at least about 90 wt. %, at least about 95 wt. %, or at least about 99 wt. %, wherein all weight percent values are on a dry basis and are based on the total weight of the at least two modified biomass feedstocks. Alternatively, or in addition, the first modified biomass feedstock may be present in the mixture of the at least two modified biomass feedstocks in an amount of less than about 100 wt. %, e.g., less about 99 wt. %, less than about 95 wt. %, less than about 90 wt. %, less than about 85 wt. %, less than about 80 wt. %, less than about 75 wt. %, less than about 70 wt. %, less than about 65 wt. %, less than about 60 wt. %, less than about 55 wt. %, less than about 50 wt. %, less than about 45 wt. %, less than about 40 wt. %, less than about 35 wt. %, less than about 30 wt. %, less than about 25 wt. %, less than about 20 wt. %, less than about 15 wt. %, less than about 10 wt. %, less than about 5 wt. %, or less than about 1 wt. %, wherein all weight percent values are on a dry basis and are based on the total weight of the at least two modified biomass feedstocks. The amount of the first modified biomass feedstock can be bounded by any two of the foregoing endpoints, or can be an open-ended range. For example, the first modified biomass feedstock can be present in the mixture of the at least two modified biomass feedstocks in an amount of at least about 10 wt. %, about 20 wt. % to about 65 wt. %, or less than about 90 wt. %.

In some embodiments, the second modified biomass feedstock exhibiting a maximum hydrolysis yield at time Y when subjected to a first condition may be present in the mixture of the at least two modified biomass feedstocks in any amount from greater than 0 wt % to less than 100 wt %, including exemplary amounts of at least about 1 wt. %, e.g., at least about 5 wt. %, at least about 10 wt. %, at least about 15 wt. %, at least about 20 wt. %, at least about 25 wt. %, at least about 30 wt. %, at least about 35 wt. %, at least about 40 wt. %, at least about 45 wt. %, at least about 50 wt. %, at least about 55 wt. %, at least about 60 wt. %, at least about 65 wt. %, at least about 70 wt. %, at least about 75 wt. %, at least about 80 wt. %, at least about 85 wt. %, at least about 90 wt. %, at least about 95 wt. %, or at least about 99 wt. %, wherein all weight percent values are on a dry basis and are based on the total weight of the at least two modified biomass feedstocks. Alternatively, or in addition, the second modified biomass feedstock may be present in the mixture of the at least two modified biomass feedstocks in an amount of less than about 100 wt. %, e.g., less about 99 wt. %, less than about 95 wt. %, less than about 90 wt. %, less than about 85 wt. %, less than about 80 wt. %, less than about 75 wt. %, less than about 70 wt. %, less than about 65 wt. %, less than about 60 wt. %, less than about 55 wt. %, less than about 50 wt. %, less than about 45 wt. %, less than about 40 wt. %, less than about 35 wt. %, less than about 30 wt. %, less than about 25 wt. %, less than about 20 wt. %, less than about 15 wt. %, less than about 10 wt. %, less than about 5 wt. %, or less than about 1 wt. %, wherein all weight percent values are on a dry basis and are based on the total weight of the at least two modified biomass feedstocks.

The amount of the second modified biomass feedstock can be bounded by any two of the foregoing endpoints, or can be an open-ended range. For example, the second modified biomass feedstock can be present in the mixture of the at least two modified biomass feedstocks in an amount of at least about 40 wt. %, about 65 wt. % to about 85 wt. %, or less than about 80 wt. %.

In some embodiments, there may be third, fourth, fifth, sixth, seventh, eighth, ninth, or tenth biomass feedstocks present in the mixture, and such feedstocks may be unmodified or modified, as defined herein. The numerical weight percent ranges disclosed herein for the first modified biomass feedstock can be used to describe the amount of any of these additional feedstocks, if present, and weight percent values are on a dry basis and are based on the total weight of all of the biomass feedstocks present.

In certain embodiments, the hydrolysis method described herein can be performed at a pH of at least 1.3. The maximum pH is not particularly limited, but typically is less than about 9. For example, the hydrolysis method can be performed at a pH of at least 1.3, e.g., at least about 1.5, e.g., at least about 1.7, at least about 1.9, at least about 2, at least about 2.2, at least about 2.6, at least about 2.8, at least about 3, at least about 3.2, at least about 3.4, at least about 3.6, at least about 3.8, at least about 4, at least about 4.2, at least about 4.4, at least about 4.6, at least about 4.8, at least about 5, at least about 5.2, at least about 5.4, at least about 5.6, at least about 5.8, at least about 6, at least about 6.2, at least about 6.4, at least about 6.6, at least about 6.8, at least about 7, at least about 7.2, at least about 7.4, at least about 7.6, at least about 7.8, at least about 8, at least about 8.2, at least about 8.4, at least about 8.6, at least about 8.8, or at least about 9. Alternatively, or in addition, the hydrolysis method can be performed at a pH of less than about 9, e.g., less than about 8.8, less than about 8.6, less than about 8.4, less than about 8.2, less than about 8, less than about 7.8, less than about 7.6, less than about 7.4, less than about 7.2, less than about 7, less than about 6.8, less than about 6.6, less than about 6.4, less than about 6.2, less than about 6, less than about 5.8, less than about 5.6, less than about 5.4, less than about 5.2, less than about 5, less than about 4.8, less than about 4.6, less than about 4.4, less than about 4.2, less than about 4, less than about 3.8, less than about 3.6, less than about 3.4, less than about 3.2, less than about 3, less than about 2.8, less than about 2.6, less than about 2.4, less than about 2.2, less than about 2, less than about 1.8, less than about 1.6, or less than about 1.4. The hydrolysis method can be performed at a pH bounded by any two of the foregoing endpoints, or can be an open-ended range, provided that the pH is at least 1.3. For example, the hydrolysis method can be performed at a pH of at least 1.3, about 1.5 to about 6, or about 7 or less.

In one embodiment, the second modified biomass feedstock may be different from the first modified biomass feedstock by a difference selected from the group consisting of compositional proportions, biomass type, biomass species, hemicellulose structure, geographical harvesting location, harvesting season, and any combination thereof.

Biomass typically is composed of several components, including, for example and without limitation, lignin, cellulose, hemicellulose, ash, and extractives, all of which may be present in various amounts (i.e., composition proportions). Some biomasses, such as lignocellulosic biomass, may include all of these components, whereas other biomasses, such as cotton, may include less than all of these components (e.g., may not contain one or more of these components). The proportions of each component may vary within the total amount of components present. For example, for a given biomass, the cellulose may be present in an amount of about 15 wt. % to about 95 wt. %, hemicellulose may be present in an amount of about 0 wt. % to about 40 wt. %, lignin may be present in an amount of about 0 wt. % to about 35 wt. %, ash may be present in an amount of about 0 wt. % to about 30 wt. %, protein may be present in an amount of about 0 wt. % to about 20 wt. %, and extractives may be present in an amount of about 0 wt. % to about 25 wt. %, based on the total weight of the biomass on a dry basis (i.e., excluding water).

In some embodiments, the compositional proportion of cellulose in a given biomass can be at least about 15 wt. %, e.g., at least about 20 wt. %, at least about 25 wt. %, at least about 30 wt. %, at least about 35 wt. %, at least about 40 wt. %, at least about 45 wt. %, at least about 50 wt. %, at least about 55 wt. %, at least about 60 wt. %, at least about 65 wt. %, at least about 70 wt. %, at least about 75 wt. %, at least about 80 wt. %, at least about 85 wt. %, or at least about 90 wt. %, based on the total weight of the biomass on a dry basis. Alternatively, or in addition, the compositional proportion of cellulose can be less than about 95 wt. %, e.g., less than about 90 wt. %, less than about 85 wt. %, less than about 80 wt. %, less than about 75 wt. %, less than about 70 wt. %, less than about 65 wt. %, less than about 60 wt. %, less than about 55 wt. %, less than about 50 wt. %, less than about 45 wt. %, less than about 40 wt. %, less than about 35 wt. %, less than about 30 wt. %, less than about 25 wt. %, or less than about 20 wt. %, based on the total weight of the biomass on a dry basis. These lower and upper limits with respect to the compositional proportion of cellulose can be used in any combination to define close-ended ranges, or can be used individually to define an open-ended range.

In some embodiments, the compositional proportion of hemicellulose in a given biomass can be at least about 0 wt. %, e.g., at least about 0.2 wt. %, at least about 0.5 wt. %, at least about 1 wt. %, at least about 5 wt. %, at least about 10 wt. %, at least about 15 wt. %, at least about 20 wt. %, at least about 25 wt. %, at least about 30 wt. %, or at least about 35 wt. %, based on the total weight of the biomass on a dry basis. Alternatively, or in addition, the compositional proportion of hemicellulose in biomass can be less than about 40 wt. %, e.g., less than about 35 wt. %, less than about 30 wt. %, less than about 25 wt. %, less than about 20 wt. %, less than about 15 wt. %, less than about 10 wt. %, less than about 5 wt. %, less than about 1 wt. %, less than about 0.5 wt. %, or less than about 0.2 wt. %, based on the total weight of the biomass on a dry basis. These lower and upper limits with respect to the compositional proportion of hemicellulose can be used in any combination to define a close-ended range, or can be used individually to define an open-ended range.

In some embodiments, the compositional proportion of lignin in a given biomass can be at least about 0 wt. %, e.g., at least about 1 wt. %, at least about 2 wt. %, at least about 5 wt. %, at least about 10 wt. %, at least about 15 wt. %, at least about 20 wt. %, at least about 25 wt. %, or at least about 30 wt. %, based on the total weight of the biomass on a dry basis. Alternatively, or in addition, the compositional proportion of lignin in the biomass can be less than about 35 wt. %, e.g., less than about 30 wt. %, less than about 25 wt. %, less than about 20 wt. %, less than about 15 wt. %, less than about 10 wt. %, less than about 5 wt. %, less than about 2 wt. %, or less than about 1 wt. %, based on the total weight of the biomass on a dry basis. These lower and upper limits with respect to the compositional proportion of lignin can be used in any combination to define a close-ended range, or can be used individually to define an open-ended range. In some embodiments, the amount of lignin is about 0 wt. %.

In some embodiments, the compositional proportion of ash in a given biomass can be at least about 0 wt. %, e.g., at least about 5 wt. %, at least about 10 wt. %, at least about 15 wt. %, at least about 20 wt. %, or at least about 25 wt. %, based on the total weight of the biomass on a dry basis. Alternatively, or in addition, the compositional proportion of ash in biomass can be less than about 30 wt. %, e.g., less than about 25 wt. %, less than about 20 wt. %, less than about 15 wt. %, less than about 10 wt. %, or less than about 5 wt. %, based on the total weight of the biomass on a dry basis. These lower and upper limits with respect to the compositional proportion of ash can be used in any combination to define a close-ended range, or can be used individually to define an open-ended range.

In some embodiments, the compositional proportion of protein in a given biomass can be at least about 0 wt. %, e.g., at least about 2 wt. %, at least about 4 wt. %, at least about 6 wt. %, at least about 8 wt. %, at least about 10 wt. %, at least about 12 wt. %, at least about 14 wt. %, at least about 16 wt. %, or at least about 18 wt. %, based on the total weight of the biomass on a dry basis. Alternatively, or in addition, the compositional proportion of protein can be less than about 20 wt. %, e.g., less than about 18 wt. %, less than about 16 wt. %, less than about 14 wt. %, less than about 12 wt. %, less than about 10 wt. %, less than about 8 wt. %, less than about 6 wt. %, less than about 4 wt. %, or less than about 2 wt. %, based on the total weight of the biomass on a dry basis. These lower and upper limits with respect to the compositional proportion of protein can be used in any combination to define a close-ended range, or can be used individually to define an open-ended range. In some embodiments, the content of protein is 0 wt. %.

In some embodiments, the compositional proportion of extractives in a given biomass can be at least about 0 wt. %, e.g., at least about 5 wt. %, at least about 10 wt. %, at least about 15 wt. %, or at least about 20 wt. %, based on the total weight of the biomass on a dry basis. Alternatively, or in addition, the compositional proportion of extractives may be less than about 25 wt. %, e.g., less than about 20 wt. %, less than about 15 wt. %, less than about 10 wt. %, or less than about 5 wt. %, based on the total weight of the biomass on a dry basis. These lower and upper limits with respect to the compositional proportion of extractives can be used in any combination to define a close-ended range, or can be used individually to define an open-ended range.

In certain embodiments, the second modified biomass feedstock can be a different biomass species than the first modified biomass feedstock. For example and without limitations, biomass species may be any land or marine species. In some embodiments and without limitations the biomass species may include balsam, sugar cane, sugar cane bagasse, corn, soy beans, any aquatic species, agave, guayule, tobacco leaves, palm trees, apple pomice, bamboo, banana fruit, banana peel, banana leaves, banana pseudostem, banana rachis, citrus waste, coffee grinds, corn cobs, corn stover, energy cane, mix hardwoods, *miscanthus*, mixed softwoods, palm empty fruit bunches, palm fruit fronds, palm fruit press fiber, palm, felled fruit trunks, paper mill sludge, pineapple waste, rice husks, rice straw, sago palm, birch, bioslurry, clean paper, paper waste, construction wood, mixed paper, wood waste, willow, loblolly pine, bark, aspen, black ash, basswood, red oak, paper birch, red maple, sugar maple, balm poplar, rotten aspen, american sycamore, big bluestem, black locust, cellulose sludge, eastern cottonwood (*populus deltoides*), *eucalyptus*, forage sorghum, hybrid poplar, monterey pine (*pinus radiata*), *sericea lespedeza*, solka floc, sweet sorghum, switchgrass, tall fescue, wheat straw (*triticum aestivum*), yellow poplar, or any combination thereof.

In some embodiments, the second modified biomass feedstock and the first modified biomass feedstock may be harvested from different geographical locations, such that the first and second modified biomasses are considered to be "different" as used herein. Distance is defined herein as the shortest distance between two points. For example, the second modified biomass feedstock and the first modified biomass feedstock may have been harvested at harvesting locations at least about 30 miles apart, e.g., at least about 50 miles apart, at least about 100 miles apart, at least about 500 miles apart, at least about 1,000 miles apart, at least about 5,000 miles apart, at least about 10,000 miles apart, or at least about 12,500 miles apart. Alternatively, or in addition, the second modified biomass feedstock and the first modified biomass feedstock may have been harvested at harvesting locations less than about 12,500 miles apart, e.g., less than about 10,000 miles apart, less than about 5,000 miles apart, less than about 1,000 miles apart, less than about 500 miles apart, less than about 100 miles apart, or less than about 50 miles apart. These lower and upper limits with respect to the geographical harvesting location can be used in any combination to define a close-ended range, or can be used individually to define an open-ended range. In some embodiments, the second modified biomass may be the same species as the first modified biomass, but harvested from different geographic locations, as defined herein. In this case, the first and second biomasses would be considered "different" as used herein.

In further embodiments, the first and second modified biomasses may be different biomass types, and the biomass types of the first and second modified biomass feedstocks may be independently selected from the group consisting of a softwood biomass, a hardwood biomass, an annual fiber biomass, a non-woody biomass, municipal solid waste, and any combination thereof. In one embodiment, for example, softwood biomass and hardwood biomass may include but are not limited to, the woody parts of a tree, whole tree chips, bole chips, mill chips, manufacturing residues, timber harvest residuals, post-consumer or post-industrial wood waste, urban and agricultural wood waste. In one embodiment, manufacturing residues may include wood chips, shavings, sawdust, and bark left over from the production of lumber and structural panels. In another embodiment, timber harvest residuals may include tops and limbs too small for lumber production or containing too much bark for pulp use. Trees of low value may also be chipped whole for use in energy production. In a yet further embodiment, post-consumer wood waste may include lumber from construction scraps, demolition projects, and/or wooden furniture. Material from construction projects holds higher value, as it is usually cleaner, may be devoid of nails, and is unlikely to be tainted with lead paint or other toxic materials. In even further embodiments, urban and agricultural wood waste may include tree trimmings and storm debris. Further, the agricultural wood waste may include waste from orchard pruning. In certain embodiments, the non-woody biomass may include agricultural products, waste materials, and combinations thereof. For example, and without limitations, the agricultural products may comprise any parts of the plant, including leaves, stems, and stalks. The agricultural products may further comprise perennial lignocellulosic crops. The agricultural residue may include, for example, corn stover, wheat stover, soybean stover, sugar cane bagasse, waste from grain harvesting, or waste from processing fruits (e.g., the peels, stems, pits, seeds, etc.). In another embodiment, the non-woody biomass may include animal waste, herbaceous crops, and combinations thereof.

In certain embodiments, the first and second modified biomasses may have different hemicellulose structures. For example and without limitations, the hemicellulose of the second modified biomass feedstock may have different compositional proportions of monomeric saccharides than the hemicellulose of the first modified biomass feedstock. The hemicellulose structure may include various proportions of xyloglucans, xylans, mannans and glucomannans, and β-(1→3, 1→4)-glucans. The detailed structure of the hemicelluloses and their abundance may vary widely between different species and cell types. Hemicellulose structure can also be different by the types, extent, and locations of bonding present in the hemicellulose (e.g., branching, linearity, and types, locations, and amounts of sugar linkages such as β(1,4), α(1,4), β(1,3), α(1,3), etc.). In some embodiments, biomasses with different hemicellulose structures may result in different apparent hydrolysis rates and/or different proportions of hydrolyzed monomeric saccharides under the same hydrolysis conditions.

In some embodiments, the first modified biomass feedstock is prepared by a first treatment. In some embodiments, the second modified biomass feedstock is prepared by a second treatment. In some embodiments, the first and second treatments independently are selected from the group consisting of size reduction, steam explosion, ammonia explosion, enzymatic treatment, acid treatment, base treatment, hydrothermal treatment, biological treatment, catalytic treatment, non-catalytic treatment, and any combination thereof. As used herein, the phrase "the first (or second) modified biomass feedstock is prepared by a first (or second) treatment" denotes how the biomass feedstock was prepared, but does not require that the biomass feedstock is actively prepared in such a manner as part of the hydrolysis method.

In some embodiments, the hydrolysis method further comprises preparing the first modified biomass feedstock with a first treatment. In some embodiments, the hydrolysis method further comprises preparing the second modified biomass feedstock with a second treatment. In some embodiments, the first and second treatments independently are selected from the group consisting of size reduction, steam explosion, ammonia explosion, enzymatic treatment, acid treatment, base treatment, hydrothermal treatment, biological treatment, catalytic treatment, non-catalytic treatment, and any combination thereof. As used herein, the phrase "preparing the first (or second) modified biomass feedstock with a first (or second) treatment" means that, as part of the hydrolysis method, the first or second biomass feedstocks are prepared by a specified treatment.

In some embodiments, the first treatment is same as or different from the second treatment. Treatments are considered to be "different" when one treatment is a different type than the other treatment (e.g., heat treatment vs. size reduction), or when treatments are performed to a different extent (e.g., size reduction to an average equivalent spherical particle diameter of 100 mm vs. size reduction to an average equivalent spherical particle diameter of 1 mm). Similarly, treatments are considered to be the same when the treatments are of the same type (e.g., heat treatment) and are treated to the same extent (e.g., both are heat treated for about 100 min).

In some embodiments, at least one of the first and the second treatments is size reduction. Size reduction can include any method or combination of methods that reduce the size (e.g., average equivalent spherical diameter) of a biomass feedstock. Suitable size reduction methods include any suitable mechanical comminution, including grinding or milling (e.g., ball milling, hammer milling, and/or jet milling). Size reduction can also include explosive decompression, which is discussed elsewhere herein. In some embodiments, both the first and the second treatments are size reduction. In some embodiments, an average equivalent spherical diameter of the second modified biomass feedstock is smaller than an average equivalent spherical diameter of the first modified biomass feedstock. In some embodiments, the average equivalent spherical diameter of at least one of the first and second modified biomass feedstocks can be at least about 0.01 mm, e.g., at least about 0.02 mm, at least about 0.03 mm, at least about 0.04 mm, at least about 0.05 mm, at least about 0.06 mm, at least about 0.06 mm, at least about 0.07 mm, at least about 0.08 mm, at least about 0.09 mm, at least about 0.1 mm, at least about 0.15 mm, at least about 0.2 mm, at least about 0.3 mm, at least about 0.4 mm, at least about 0.5 mm, at least about 0.6 mm, at least about 0.7 mm, at least about 0.8 mm, at least about 0.9 mm, at least about 1 mm, at least about 1.5 mm, at least about 2 mm, at least about 2.5 mm, at least about 3 mm, at least about 3.5 mm, at least about 4 mm, at least about 4.5 mm, at least about 5 mm, at least about 5.5 mm, at least about 6 mm, at least about 6.5 mm, at least about 7 mm, at least about 7.5 mm, at least about 8 mm, at least about 8.5 mm, at least about 9 mm, at least about 9.5 mm, at least about 10 mm, at least about 12 mm, at least about 14 mm, at least about 16 mm, at least about 18 mm, at least about 20 mm, at least about 22 mm, at least about 24 mm, at least about 26 mm, at least about 28 mm, at least about 30 mm, at least about 32 mm, at least about 34 mm, at least about 36 mm, at least about 38 mm, at least about 40 mm, at least about 42 mm, at least about 44 mm, at least about 46 mm, at least about 48 mm, at least about 50 mm, at least about 52 mm, at least about 54 mm, at least about 56 mm, at least about 58 mm, or at least about 60 mm. Alternatively, or in addition, the average equivalent spherical diameter of at least one of the first and second modified biomass feedstocks can be less than about 60 mm, e.g., less than about 58 mm, less than about 56 mm, less than about 54 mm, less than about 52 mm, less than about 50 mm, less than about 48 mm, less than about 46 mm, less than about 44 mm, less than about 42 mm, less than about 40 mm, less than about 38 mm, less than about 36 mm, less than about 34 mm, less than about 32 mm, less than about 30 mm, less than about 28 mm, less than about 26 mm, less than about 24 mm, less than about 22 mm, less than about 20 mm, less than about 18 mm, less than about 16 mm, less than about 14 mm, less than about 12 mm, less than about 10 mm, less than about 9.5 mm, less than about 9 mm, less than about 8.5 mm, less than about 8 mm, less than about 7.5 mm, less than about 7 mm, less than about 6.5 mm, less than about 6 mm, less than about 5.5 mm, less than about 5 mm, less than about 4.5 mm, less than about 4 mm, less than about 3.5 mm, less than about 3 mm, less than about 2.5 mm, less than about 2 mm, less than about 1.5 mm, less than about 1 mm, less than about 0.9 mm, less than about 0.8 mm, less than about 0.7 mm, less than about 0.6 mm, less than about 0.5 mm, less than about 0.4 mm, less than about 0.3 mm, less than about 0.2 mm, less than about 0.15 mm, less than about 0.1 mm, less than about 0.09 mm, less than about 0.08 mm, less than about 0.07 mm, less than about 0.06 mm, less than about 0.05 mm, less than about 0.04 mm, less than about 0.03 mm, less than about 0.02 mm, or less than about 0.01 mm. These lower and upper limits with respect to the average equivalent spherical diameter can be used in any combination to define a close-ended range, or can be used individually to define an open-ended range. These ranges can refer to the average equivalent spherical diameter of the first modified biomass feedstock, the second modified biomass feedstock, or both the first and second modified biomass feedstocks. These ranges may also refer to an average equivalent spherical diameter of other biomass feedstocks, if present (e.g., third, fourth, fifth, sixth, seventh, eighth, ninth, tenth, etc., biomass feedstocks).

In some embodiments, the second modified biomass feedstock can have an average equivalent spherical diameter of less than about 80%, e.g., less than about 75%, less than about 70%, less than about 65%, less than about 60%, less than about 55%, less than about 50%, less than about 45%, less than about 40%, less than about 35%, less than about 30%, less than about 25%, less than about 20%, less than about 15%, less than about 10%, less than about 5%, or less than about 1% of an average equivalent spherical diameter of the first modified biomass feedstock. Alternatively, or in addition, the second modified biomass feedstock can have an average equivalent spherical diameter of at least about 1%, e.g., at least about 5%, at least about 10%, at least about 15%, at least about 20%, at least about 25%, at least about 30%, at least about 35%, at least about 40%, at least about 45%, at least about 50%, at least about 55%, at least about 60%, at least about 65%, at least about 70%, or at least about 75% of an average equivalent spherical diameter of the first modified biomass feedstock. These upper and lower limits can be used in any combination to define a close-ended range, or can be used individually to define an open-ended range.

In some embodiments, at least one of the first and second treatments is explosive decompression. In explosive decompression, a biomass typically is pressurized with a fluid, such that the fluid at least partially diffuses into the pores of the biomass, and then the pressure is released at a sufficient rate to cause the fluid within the pores to expand and pulverize the biomass. Explosive decompression typically reduces the particle size (e.g., average equivalent spherical diameter) of the biomass. Any suitable fluid can be used in the explosive decompression, including, but not limited to, water, ammonia, methanol, ethanol, carbon dioxide, sulfur dioxide, or any combination thereof.

In an embodiment, the explosive decompression treatment is steam explosion, in which the fluid typically comprises, consists of, or consists essentially of water. In some embodiments, a steam explosion treatment reduces the size (e.g., average equivalent spherical diameter) of a biomass feedstock. Suitable sizes or size ranges for the first and/or second modified biomass feedstock are the same as those sizes and size ranges disclosed herein with respect to size reduction.

In some embodiments, the explosive decompression is ammonia explosion, in which the fluid typically comprises, consists of, or consists essentially of ammonia. In some embodiments, at least one of the first and the second treatments is ammonia explosion (e.g., ammonia fiber explosion (AFEX)). In ammonia explosion, biomass typically is treated with liquid anhydrous ammonia at temperatures of about 50° C. to about 150° C. and pressures of about 10 bar to about 100 bar. Treatment times typically are short, e.g., about 1 min to about 20 min, more preferably about 5 min. The pressure is then rapidly released, thereby disintegrating the biomass into smaller sizes. Typically the ammonia can be recovered and recycled into the process. Water typically is not added for the ammonia explosion treatment. The biomass need not be dried prior to use (i.e., it can retain the moisture content it has at ambient conditions).

In some embodiments, at least one of the first and second treatments is an enzymatic treatment. Enzymatic treatments may involve enzymes such as xylanase, cellulase, or a combination thereof. Enzymatic treatments may also include enzyme complexes or cocktails, such as the CELLIC line of enzyme products available from Novozymes. Enzymatic treatments may also be carried out with proteins or polypeptides having enzymatic activity (i.e., activity similar to that of bona fide enzymes).

In some embodiments, at least one of the first and second treatments is an acid treatment. Suitable acids for use in the acid treatment may include nitric acid, formic acid, acetic acid, sulfuric acid, hydrochloric acid, hydrobromic acid, carbonic acid (e.g., generated from $CO_2$), sulfurous acid (e.g., generated in situ from $SO_2$), or any combination thereof.

In another embodiment, at least one of the first and second treatments is base treatment. Suitable bases for use in the base treatment may include an alkali metal hydroxide (e.g., sodium, potassium, or cesium hydroxide), an alkaline earth metal hydroxide (magnesium, calcium, strontium, or barium hydroxide), ammonia hydroxide, calcium oxide, carbonates (e.g., sodium or potassium carbonate), alkyl amines (e.g., ethanol amine, triethyl amine), pyridine, or any combination thereof.

In yet another embodiment, at least one of the first and the second treatments is hydrothermal treatment. Typically, a hydrothermal treatment involves treating a biomass with hot water. Water typically is added to the biomasss, and the temperature and/or pressure elevated for a specific period of time. Suitable temperatures include about 50° C. to about 200° C., and suitable pressures include about 5 bar to about 100 bar.

In some embodiments, at least one of the first and second treatments is biological treatment. As used herein, a biological treatment is a treatment that is effected by one or more organisms (e.g., bacteria, yeast, algae, fungi, insects, and the like). Suitable conditions for the biological treatment include a pH of 5 to about 8, a temperature of about 30° C. to about 60° C., and pressures of about ambient (e.g., about 10 psia to about 20 psia, e.g., about 14.7 psia).

In some embodiments, at least one of the first and the second treatments is a catalytic treatment. As used herein, a catalytic treatment is a treatment effected by one or more catalysts or other agents having catalytic activity (e.g., acid, base, metal, and the like).

In some embodiments, at least one of the first and second treatments is a non-catalytic treatment. As used herein, a non-catalytic treatment is a treatment effected by one or more reactants or reagents that are consumed in the reaction (e.g., a reactant or reagent).

In some embodiments, combinations of treatments are specifically contemplated. For example, a first treatment (or a second treatment) may include both size reduction and acid treatment. In this case, the "treatment" is not a single type of treatment, but rather is a combination of both size reduction and acid treatment, which may be performed simultaneously or sequentially. Any combination of the aforementioned treatments, e.g., in double, triple, quadruple, quintuple, etc., is contemplated.

Typically, different biomass feedstocks hydrolyze at different rates. Without wishing to be bound by any theory, it is hypothesized that for large particles or large chips, hydrolysis occur in the pores of the particles, and then sugars and by-products need to diffuse out into the liquid surrounding the particle, which constitutes the bulk liquor (e.g., main hydrolysate). In this situation, the concentration of the products typically is higher inside the particles than it is outside the particles. This concentration difference provides the driving force for products to diffuse into the bulk liquid phase. The overall (i.e., apparent) rate of hydrolysis is a complex function of the diffusion coefficients, the particle size, and the intrinsic reaction rate. In one embodiment, if the diffusion coefficient and the intrinsic reaction rate are fixed (i.e., constant), the apparent reaction rate of the formation of sugars and by-products will depend mainly (or only) on the particle size. Without wishing to be bound by any theory, apparent or observed rate is assumed to be the rate of formation or disappearance of species that are observed during the reaction. These apparent or observed rates are different than the intrinsic rates, since the magnitude of the apparent or observed rates includes the diffusional effects relating to the particle size. In other words, apparent or observed rate is a measure of combined diffusion and reaction rates. It is further understood that, the larger the particle size is, the slower the observed rate becomes. For fine particles, diffusion typically does not dominate, and the concentration of sugars inside the pores of the particle and the concentration of the hydrolyzate surrounding the particle becomes the same, and the apparent rate for hydrolysis increases relative to the apparent rate for the large particle size. The foregoing principles are demonstrated by the Examples set forth herein.

In some embodiments, the first modified biomass feedstock and the second modified biomass feedstock can be mixed together in weight ratios of about 1:25 to about 25:1 (i.e., weight ratio of the first biomass feedstock to the second biomass feedstock). For example, the first and second modified biomass feedstocks can be present in a weight ratio of at least about 1:25, e.g., at least about 1:24, at least about 1:22, at least about 1:20, at least about 1:18, at least about 1:16, at least about 1:14, at least about 1:12, at least about 1:10, at least about 1:8, at least about 1:6, at least about 1:4, at least about 1:2, or at least about 1:1. Alternatively, or in addition, the first and second modified biomass feedstocks can be present in weight ratios of less than about 25:1, e.g., less than about 24:1, less than about 22:1, less than about 20:1, less than about 18:1, less than about 16:1, less than about 14:1, less than about 12:1, less than about 10:1, less than about 8:1, less than about 6:1, less than about 4:1, or less than about 2:1. These lower and upper limits with respect to the weight ratios of the first and second modified biomass feedstocks can be used in any combination to define a close-ended range, or can be used individually to define an open-ended range.

In some embodiments, the first and second modified biomass feedstocks can be subjected to a first condition. The "first condition" is a set of specific temperature, pressure, and/or time conditions used for biomass hydrolysis, for example, to hydrolyze the first and/or second modified biomass feedstocks, either alone or in combination, as will be clear from the relevant context. In some embodiments, the first condition is selected from the group consisting of hot water extraction, acidic hot water extraction, sub-critical fluid extraction, near-critical fluid extraction, supercritical fluid extraction, enzymatic treatment, and any combination thereof. The specific apparatus, setup, or method used to subject the modified biomass feedstocks to the first condition is not particularly limited. For example, the apparatus, setup, or method can be or can employ a digester, a flow-through reactor, a batch reactor, or any combination thereof. Suitable digester systems are disclosed, e.g., in U.S. Pat. No. 8,057,639, hereby incorporated by reference in its entirety.

In another embodiment, the first condition can be sub-critical fluid extraction, near-critical fluid extraction or supercritical fluid extraction. The pressures and temperatures for sub-critical fluid, near-critical fluid, or supercritical fluid extraction will vary with the choice of fluid or fluids used in the extraction. In one embodiment, the extraction fluid is selected from the group consisting of water, carbon dioxide, sulfur dioxide, methanol, ethanol, and any combination thereof. In a preferred embodiment, the extraction fluid comprises, consists of, or consists essentially of water. In other preferred embodiments, the extraction fluid is a combination of water and ethanol, water and carbon dioxide, or water and sulfur dioxide. In some embodiments, the sub-critical fluid, near-critical fluid, or supercritical fluid extraction does not comprise an exogenous acid (i.e., does not comprise an acid deliberately added to the extraction fluid).

The sub-critical, near-critical or supercritical fluid extraction can be performed at any suitable temperature. Suitable temperatures include, for example, about 50° C. or more, e.g., about 60° C. or more, about 70° C. or more, about 80° C. or more, about 90° C. or more, about 100° C. or more, about 110° C. or more, about 120° C. or more, about 130° C. or more, about 140° C. or more, about 150° C. or more, about 160° C. or more, about 170° C. or more, about 180° C. or more, about 190° C. or more, about 200° C. or more, about 210° C. or more, about 220° C. or more, about 230° C. or more, about 240° C. or more, about 250° C. or more, about 260° C. or more, about 270° C. or more, about 280° C. or more, about 290° C. or more, about 300° C. or more, about 310° C. or more, about 320° C. or more, about 330° C. or more, about 340° C. or more, about 350° C. or more, about 360° C. or more, about 370° C. or more, about 380° C. or more, about 390° C. or more, about 400° C. or more, about 410° C. or more, about 420° C. or more, about 430° C. or more, about 440° C. or more, about 450° C. or more, about 460° C. or more, about 470° C. or more, about 480° C. or more, or about 490° C. or more. The maximum temperature is not particularly limited, but typically will be about 500° C. or less, e.g., about 490° C. or less, about 480° C. or less, about 470° C. or less, about 460° C. or less, about 450° C. or less, about 440° C. or less, about 430° C. or less, about 420° C. or less, about 410° C. or less, about 400° C. or less, about 390° C. or less, about 380° C. or less, about 370° C. or less, about 360° C. or less, about 350° C. or less, about 340° C. or less, about 330° C. or less, about 320° C. or less, about 310° C. or less, about 300° C. or less, about 290° C. or less, about 280° C. or less, about 270° C. or less, about 260° C. or less, about 250° C. or less, about 240° C. or less, about 230° C. or less, about 220° C. or less, about 210° C. or less, about 200° C. or less, about 190° C. or less, about 180° C. or less, about 170° C. or less, about 160° C. or less, about 150° C. or less, about 140° C. or less, about 130° C. or less, about 120° C. or less, about 110° C. or less, about 100° C. or less, about 90° C. or less, about 80° C. or less, about 70° C. or less, or about 60° C. or less. These lower and upper temperature limits can be used in any combination to define a close-ended range, or can be used individually to define an open-ended range.

The sub-critical, near-critical or supercritical fluid extraction can be performed at any suitable pressure. Suitable pressures include, for example, about 1 bar or more, e.g., about 5 bar or more, about 10 bar or more, about 20 bar or more, about 30 bar or more, about 40 bar or more, about 50 bar or more, about 60 bar or more, about 70 bar or more, about 80 bar or more, about 90 bar or more, about 100 bar or more, about 125 bar or more, about 150 bar or more, about 175 bar or more, about 200 bar or more, about 225 bar or more, about 250 bar or more, about 275 bar or more, about 300 bar or more, or about 325 bar or more. The maximum pressure is not particularly limited, but typically will be about 350 bar or less, e.g., about 325 bar or less, about 300 bar or less, about 275 bar or less, about 250 bar or less, about 225 bar or less, about 200 bar or less, about 175 bar or less, about 150 bar or less, about 125 bar or less, about 100 bar or less, about 90 bar or less, about 80 bar or less, about 70 bar or less, about 60 bar or less, about 50 bar or less, about 40 bar or less, about 30 bar or less, about 20 bar or less, about 10 bar or less, or about 5 bar or less. These lower and upper pressure limits can be used in any combination to define a close-ended range, or can be used individually to define an open-ended range. In some preferred embodiments, the pressure is sufficient to maintain the fluid in liquid form. In some preferred embodiments, the pressure is sufficient to maintain the fluid in supercritical form.

The sub-critical, near-critical or supercritical fluid extraction can be performed for any suitable residence time. Suitable residence times include at least about 0.1 sec, e.g., at least about 0.2 sec, at least about 0.3 sec, at least about 0.4 sec, at least about 0.5 sec, at least about 0.6 sec, at least about 0.7 sec, at least about 0.8 sec, at least about 0.9 sec, at least about 1 sec, at least about 1.1 sec, at least about 1.2 sec, at least about 1.3 sec, at least about 1.4 sec, at least about 1.5 sec, at least about 1.6 sec, at least about 1.7 sec, at least about 1.8 sec, at least about 1.9 sec, at least about 2 sec, at least about 3 sec, at least about 4 sec, at least about 5 sec, at least about 6 sec, at least about 7 sec, at least about 8 sec, at least about 9 sec, at least about 10 sec, at least about 20 sec, at least about 30 sec, at least about 40 sec, at least about 50 sec, at least about 60 sec, at least about 2 min, at least about 4 min, at least about 6 min, at least about 8 min, at least about 10 min, at least about 20 min, at least about 30 min, at least about 40 min, at least about 50 min, at least about 60 min, at least about 70 min, at least about 80 min, at least about 90 min, at least about 100 min, at least about 110 min, at least about 120 min, at least about 130 min, at least about 140 min, at least about 150 min, at least about 160 min, at least about 170 min, at least about 180 min, at least about 190 min, at least about 200 min, at least about 220 min, at least about 240 min, at least about 260 min, at least about 280 min, or at least about 300 min. Alternatively, or in addition, suitable residence times include less than about 300 min, e.g., less than about 280 min, less than about 260 min, less than about 240 min, less than about 220 min, less than about 200 min, less than about 190 min, less than about 180 min, less than about 170 min, less than about 160 min, less than about 150 min, less than about 140 min, less than about 130 min, less than about 120 min, less than about 110 min, less than about 100 min, less than about 90 min, less than about 80 min, less than about 70 min, less than about 60 min, less than about 50 min, less than about 40 min, less than about 30 min, less than about 20 min, less than about 10 min, less than about 8 min, less than about 6 min, less than about 4 min, less than about 2 min, less than about 60 sec, less than about 50 sec, less than about 40 sec, less than about 30 sec, less than about 20 sec, less than about 10 sec, less than about 9 sec, less than about 8 sec, less than about 7 sec, less than about 6 sec, less than about 5 sec, less than about 4 sec, less than about 3 sec, less than about 2 sec, less than about 1.9 sec, less than about 1.8 sec, less than about 1.7 sec, less than about 1.6 sec, less than about 1.5 sec, less than about 1.4 sec, less than about 1.3 sec, less than about 1.2 sec, less than about 1.1 sec, less than about 1 sec, less than about 0.9 sec, less than about 0.8 sec, less than about 0.7 sec, less than about 0.6 sec, less than about 0.5 sec, less than about 0.4 sec, less than about 0.3 sec, less than about 0.2 sec, or less than about 0.1 sec. These lower and upper residence time limits can be used in any combination to define a close-ended range, or can be used individually to define an open-ended range.

In certain embodiments the first condition can be an enzymatic treatment. In one embodiment the enzymatic treatment may be performed for example and without limitations at about pH of 5 to about pH of 8 (e.g., a pH of about 5 to 7, about 6 to 8, or about 6 to 7), and a temperature from about 25° C. to about 75° C. (e.g., about 30° C. to 40° C., about 25° C. to 45° C. or about 35° C. to about 45° C.), and in the presence of any enzymes capable of hydrolyzing the biomass feedstocks, including xylanases, cellulases, enzyme cocktails, and combinations thereof.

In some embodiments, the first condition can be hot water extraction. In one embodiment, the hot water extraction is free or substantially free of the presence of any exogenous acid. In another embodiment, the hot water extraction can be performed at any of the pH values or ranges recited herein for the hydrolysis method. As used herein, hot water extraction does not comprise an exogenous acid (i.e., does not comprise an acid deliberately added to the hot water extraction fluid)

The hot water extraction can be performed at any suitable temperature. For example, the temperature can be at least about 100° C., e.g., at least about 110° C., at least about 120° C., at least about 130° C., at least about 140° C., at least about 150° C., at least about 160° C., at least about 170° C., at least about 180° C., at least about 190° C., at least about 200° C., at least about 210° C., at least about 220° C., at least about 230° C., at least about 240° C., at least about 250° C., at least about 260° C., at least about 270° C., at least about 280° C., at least about 290° C., or at least about 300° C. Alternatively, or in addition, the temperature can be less than about 300° C., e.g., less than about 290° C., less than about 280° C., less than about 270° C., less than about 260° C., less than about 250° C., less than about 240° C., less than about 230° C., less than about 220° C., less than about 210° C., less than about 200° C., less than about 190° C., less than about 180° C., less than about 170° C., less than about 160° C., less than about 150° C., less than about 140° C., less than about 130° C., less than about 120° C., or less than about 110° C. These upper and lower temperature limits can be used in any combination to define a close-ended range, or can be used individually to define an open-ended range.

The hot water extraction can be performed at any suitable pressure range. In some embodiments, the pressure is at a level sufficient to keep the extraction fluid in liquid form. In some embodiments, the pressure is sufficient to keep all of the extraction fluid in liquid form, or is sufficient to keep all of an identified component thereof (e.g., water) in liquid form. When the hot water extraction employs hot water, the hot water extraction can be performed at a pressure sufficient to maintain all of the hot water in liquid form. The pressure can be at least about 1 bar, e.g., at least about 10 bar, at least about 20 bar, at least about 30 bar, at least about 40 bar, at least about 50 bar, at least about 60 bar, at least about 70 bar, at least about 80 bar, at least about 90 bar, at least about 100 bar, at least about 110 bar, at least about 120 bar, at least about 130 bar, at least about 140 bar, at least about 150 bar, at least about 160 bar, at least about 170 bar, at least about 180 bar, at least about 190 bar, at least about 200 bar, at least about 210 bar, at least about 220 bar, at least about 230 bar, at least about 240 bar, at least about 250 bar, at least about 260 bar, at least about 270 bar, at least about 280 bar, or at least about 290 bar. Alternatively, or in addition, the pressure can be less than about 300 bar, e.g., less than about 290 bar, less than about 280 bar, less than about 270 bar, less than about 260 bar, less than about 250 bar, less than about 240 bar, less than about 230 bar, less than about 220 bar, less than about 210 bar, less than about 200 bar, less than about 190 bar, less than about 180 bar, less than about 170 bar, less than about 160 bar, less than about 150 bar, less than about 140 bar, less than about 130 bar, less than about 120 bar, less than about 110 bar, less than about 100 bar, less than about 890 bar, less than about 80 bar, less than about 70 bar, less than about 60 bar, less than about 50 bar, less than about 40 bar, less than about 30 bar, less than about 20 bar, or less than about 10 bar. These upper and lower pressure limits can be used in any combination to define a close-ended range, or can be used individually to define an open-ended range.

The hot water extraction may be performed for any suitable residence time. Suitable residence times include at least about 1 min, e.g., at least about 5 min, at least about 10 min, at least about 20 min, at least about 30 min, at least about 40 min, at least about 50 min, at least about 60 min, at least about 70 min, at least about 80 min, at least about 90 min, at least about 100 min, at least about 110 min, at least about 120 min, at least about 130 min, at least about 140 min, at least about 150 min, at least about 160 min, at least about 170 min, at least about 180 min, at least about 190 min, at least about 200 min, at least about 220 min, at least about 240 min, at least about 260 min, at least about 280 min, or at least about 300 min. Alternatively, or in addition, suitable residence times include less than about 300 min, e.g., less than about 280 min, less than about 260 min, less than about 240 min, less than about 220 min, less than about 200 min, less than about 190 min, less than about 180 min, less than about 170 min, less than about 160 min, less than about 150 min, less than about 140 min, less than about 130 min, less than about 120 min, less than about 110 min, less than about 100 min, less than about 90 min, less than about 80 min, less than about 70 min, less than about 60 min, less than about 50 min, less than about 40 min, less than about 30 min, less than about 20 min, less than about 10 min, or less than about 5 min. These upper and lower residence time limits can be used in any combination to define a close-ended range, or can be used individually to define an open-ended range.

In some embodiments, the first condition can be acidic hot water extraction. Any suitable acid may be used in the acidic hot water extraction, including organic acids, inorganic acids, or a combination thereof. For example and without limitations, the acid hot water extraction may be performed in the presence of sulfuric acid, hydrochloric acid, nitric acid, acetic acid, citric acid, boric acid, carbonic acid, hydrofluoric acid, oxalic acid, phosphoric acid, chromic acid, solid acids, or any combination thereof. The temperature, pressure, and residence time ranges recited hereinabove for the hot water extraction are equally applicable to the acidic hot water extraction.

In certain embodiments, described herein is a hydrolysis method comprising:

(1) providing at least two modified biomass feedstocks comprising:
  (a) from greater than 0 wt % to less than 100 wt % of a first modified biomass feedstock exhibiting a maximum hydrolysis yield at time X, when subjected to a first condition; and
  (b) from greater than 0 wt % to less than 100 wt % of a second modified biomass feedstock exhibiting a maximum hydrolysis yield at time Y, when subjected to the first condition;
  wherein:
  the second modified biomass feedstock is different from the first modified biomass feedstock;
  time X is less than or equal to time Y;
  and time X and time Y differ by less than or equal to about 100% of time X; and
(2) subjecting a mixture of the first modified biomass feedstock and the second modified biomass feedstock to the first condition to achieve a maximum hydrolysis yield at time Z, wherein time Z is less than time Y;

wherein:

the hydrolysis method is performed at a pH of at least 1.3; and all weight percent values are on a dry basis and are based on the total weight of the at least two modified biomass feedstocks.

In some embodiments, time Z is less than time Y, in which time Z is the time to achieve a maximum hydrolysis yield of a mixture of the first modified biomass feedstock and the second modified biomass feedstock at a first condition, and time Y is the time to achieve a maximum hydrolysis yield of the second modified biomass feedstock at the first condition (i.e., when hydrolyzed separately and not in a mixture with the first modified biomass feedstock). For example, time Z can be less than about 99%, e.g., less than about 97%, less than about 95%, less than about 93%, less than about 90%, less than about 87%, less than about 85%, less than about 83%, less than about 80%, less than about 75%, less than about 70%, less than about 65%, less than about 60%, less than about 55%, less than about 50%, less than about 45%, less than about 40%, less than about 35%, less than about 30%, less than about 25%, less than about 20%, less than about 15%, or less than about 10% of time Y.

In one embodiment, the maximum hydrolysis yield at time Z achieved in the subjecting the mixture to the first condition is higher than an average of the maximum hydrolysis yields of the first and second modified biomass feedstocks at time X and Y, respectively. The average of the maximum hydrolysis yields of the first and second modified biomass feedstocks at time X and Y can be calculated by summing the two hydrolysis yields and dividing by two. In another embodiment, the maximum hydrolysis yield achieved in the subjecting the mixture to the first condition is at least about 1% higher than the average of the maximum hydrolysis yields at times X and Y. For example and without limitations, the maximum hydrolysis yield achieved in the subjecting the mixture to the first condition is at least about 1% higher, e.g., at least about 2% higher, at least about 3% higher, at least about 4% higher, at least about 5% higher, at least about 6% higher, at least about 7% higher, at least about 8% higher, at least about 9% higher, at least about 10% higher, at least about 12% higher, at least about 14% higher, at least about 16% higher, at least about 18% higher, at least about 20% higher, at least about 22% higher, at least about 24% higher, or at least about 25% higher than the average of the maximum hydrolysis yields at times X and Y for the first and second modified biomass feedstocks, respectively.

In some embodiments, time Z is less than an average of time X and time Y. The average of time X and time Y can be calculated by summing time X and time Y and dividing by two. Time Z can be, for example, at least about 1% less, e.g., at least about 2% less, at least about 3% less, at least about 4% less, at least about 5% less, at least about 6% less, at least about 7% less, at least about 8% less, at least about 9% less, at least about 10% less, at least about 11% less, at least about 12% less, at least about 13% less, at least about 14% less, at least about 15% less, at least about 20% less, at least about 25% less, or at least about 30% less than the average of time X and time Y. In some embodiments, time Z is not the same as an average of time X and time Y.

In some embodiments, time X and time Y differ by less than or equal to about 150% of time X (i.e., the difference between time X and time Y is less than or equal to about 1.5 times time X). For example, time X and time Y differ by less than about 150%, e.g., less than about 140%, e.g., less than about 130%, less than about 120%, less than about 110%, less than about 100%, less than about 90%, less than about 80%, less than about 70%, less than about 60%, less than about 50%, less than about 40%, less than about 30%, less than about 20%, less than about 10%, of time X. Alternatively, or in addition, time X and time Y differ by at least about 10%, e.g., at least about 20%, at least about 30%, at least about 40%, at least about 50%, at least about 60%, at least about 70%, at least about 80%, at least about 90%, at least about 100%, at least about 110%, at least about 120%, at least about 130%, at least about 140%, or at least about 150%, of time X.

These lower and upper limits can be used in any combination to define a close-ended range, or can be used individually to define an open-ended range. In a preferred embodiment, time X and time Y differ by less than or equal to about 100% of time X. In some embodiments, time X and time Y are not the same.

In some embodiments, a first degradation yield of a degradation product at time Z achieved in the subjecting the mixture to the first condition is lower than at least one of (1) a second degradation yield of the degradation product of the first modified biomass feedstock at time X, when subjected to the first condition, and (2) a third degradation yield of the degradation product of the second modified biomass feedstock at time Y, when subjected to the first condition. In one embodiment, the first degradation yield of a degradation product at time Z is lower than the second degradation yield at time X. In one embodiment, the first degradation yield of a degradation product at time Z is lower than third degradation yield at time X. In one embodiment, the first degradation yield of a degradation product at time Z is lower than both the second degradation yield at time X and the third degradation yield at time Y. In some embodiments, the first degradation yield of a degradation product at time Z is lower than an arithmetic average of the second degradation yield at time X and the third degradation yield at time Y. For example, the first degradation yield of a degradation product at time Z can be lower than the second degradation yield of a degradation product at time X, the third degradation yield of a degradation product at time Y, and/or an average of the degradation yields of a degradation product at time X and time Y, by about 1% or less, about 2% or less, about 4% or less, about 6% or less, about 8% or less, about 10% or less, about 12% or less, about 14% or less, about 16% or less, about 18% or less, about 20% or less, about 25% or less, about 30% or less, about 35% or less, about 40% or less, about 45% or less, about 50% or less, about 55% or less, about 60% or less, about 65% or less, about 70% or less, about 75% or less, about 80% or less, about 85% or less, about 90% or less, about 95% or less, or about 99% or less. The lower limit is not particularly limited, but can be greater than 0%, e.g., at least about 1%, at least about 2%, at least about 4%, at least about 6%, at least about 8%, at least about 10%, at least about 12%, at least about 14%, at least about 16%, at least about 18%, at least about 20%, at least about 25%, at least about 30%, at least about 35%, at least about 40%, at least about 45%, at least about 50%, at least about 55%, at least about 60%, at least about 65%, at least about 70%, at least about 75%, at least about 80%, at least about 85%, at least about 90%, or at least about 95%. The percent lower that the first degradation yield of a degradation product at time Z can be relative to the other degradation yields (as described hereinabove) can be bounded by any two of the foregoing ranges, or can be an open-ended range. In one embodiment, the degradation product is selected from the group consisting of furfural, hydroxylmethyl furfural (HMF), organic acids (e.g., formic acid, lactic acid, levulinic acid, etc.), and any combination thereof. In yet another embodiment, the degradation product is furfural. The degradation yield may refer to a single degradation product, or the degradation yield may be the sum of two or more degradation products.

The present invention is further defined in the following Examples, in which all parts and percentages are by weight, unless otherwise stated. It should be understood that these examples, while indicating preferred embodiments of the invention, are given by way of illustration only and are not to be construed as limiting in any manner. From the above discussion and these examples, one skilled in the art can ascertain the essential characteristics of this invention, and without departing from the spirit and scope thereof, can make various changes and modifications of the invention to adapt it to various usages and conditions.

EXAMPLES

The following examples are put forth so as to provide those of ordinary skill in the art with a complete disclosure and description of how the compounds, compositions, articles, devices and/or methods claimed herein are made and evaluated, and are intended to be purely exemplary and are not intended to limit the disclosure. Efforts have been made to ensure accuracy with respect to numbers (e.g., amounts, temperature, etc.), but some errors and deviations may be present. Unless indicated otherwise, parts are parts by weight, temperature is in ° C. or is at ambient temperature, and pressure is at or near atmospheric. Unless indicated otherwise, percentages referring to composition are in terms of wt %.

Example 1

This example is a theoretical simulation that demonstrates the effect of biomass particle/chip size on the rate of xylose and xylo-oligosaccharide (XOS) formation, xylan conversion, release of acetic acid, and formation of furfural. The simulation employs reaction engineering and physical principles to simulate and mathematically model the hydrolysis of biomass. The simulation provides the overall hydrolysis rates for different species, and the simulation accounts, for example, for diffusion coefficients, particle size distribution, and intrinsic reaction rates.

Figure 3:
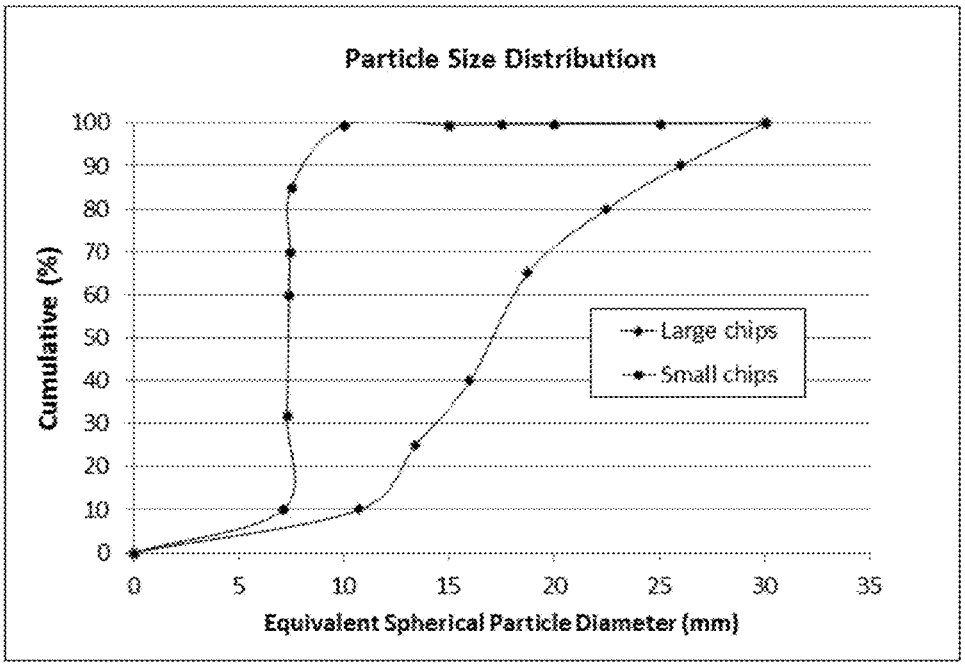
FIG. 3 shows the particle size distribution used for the simulations of Examples 1-3.

In a first simulated experiment, a 2000 g batch of hardwood chips with a 50% moisture content were charged to a reactor along with 1500 g of water and auto-hydrolyzed (with no addition of exogenous catalyst). The addition of water brings the liquid-to-solid (dry basis) ratio to 2.5:1. The hardwood chips have the particle size distribution shown in FIG. 3 for the "large chips," which distribution is also shown in Table 1. The weighted average of the equivalent spherical diameter of the particles used in this simulation is about 19.1 mm. The behavior (rate of hydrolysis, acetic acid release, furfural formation, etc.) of the biomass during the hydrolysis simulation is meant to approximate the behavior of a hardwood biomass having the indicated particle size distribution.

TABLE 1

Equivalent spherical diameter distribution for the first simulation in Example 1 "Large chips"

| Equivalent Spherical Diameter (mm) | Amount (%) |
|---|---|
| 10.75 | 10 |
| 13.4 | 15 |
| 16 | 15 |
| 18.75 | 25 |
| 22.5 | 15 |
| 26 | 10 |
| 30 | 10 |

The heating profile and results of this simulation are shown in FIG. 1. Specifically, FIG. 1 depicts the rate of formation of xylose and xylo-oligosaccharides (XOS), conversion of xylan, release of acetic acid, and formation of furfural for a hardwood biomass that has been sized reduced (i.e., modified) to the particle size distribution for "large chips" shown in FIG. 3. The yield of xylose and XOS in this simulation is about 33.2%, as defined elsewhere herein, and the xylan conversion is about 76.4%. FIG. 1 shows the amount of xylose, XOS, acetic acid, and furfural contained within the pores of the biomass ("Entrapped") and free in the bulk extraction liquor ("Free").

In a second simulated experiment, a 2000 g batch of hardwood chips with a 50% moisture content were charged to a reactor along with 1500 g or water and auto-hydrolyzed (with no addition of exogenous catalyst). The addition of water brings the liquid-to solid (dry basis) ratio to 2.5:1. The hardwood chips have the particle size distribution shown in FIG. 3 for the "small chips," which distribution is also shown in Table 2. The weighted average of the equivalent spherical diameter of the particles used in this simulation is about 7.57 mm. The behavior (rate of hydrolysis, acetic acid release, furfural formation, etc.) of the biomass during the hydrolysis simulation is meant to approximate the behavior of a hardwood biomass having the indicated particle size distribution.

TABLE 2

Equivalent spherical diameter distribution for the second simulation in Example 1 "Small chips"

| Equivalent Spherical Diameter (mm) | Amount (%) |
|---|---|
| 7.5 | 99.4 |
| 10 | 0.1 |
| 15 | 0.1 |
| 17.5 | 0.1 |
| 20 | 0.1 |
| 25 | 0.1 |
| 30 | 0.1 |

Figure 2:
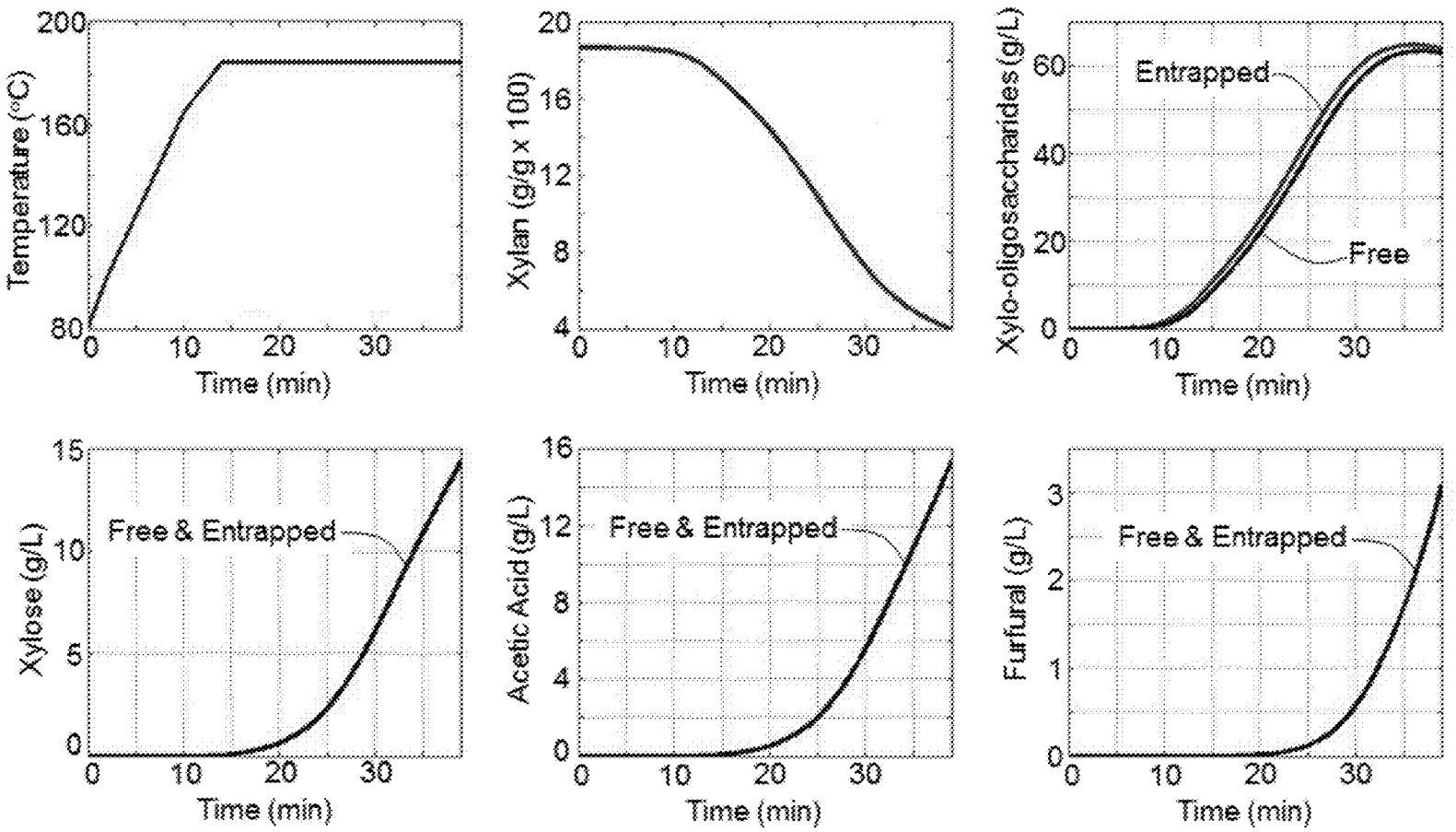
FIG. 2 shows the simulated results of another biomass hydrolysis experiment in Example 1.

The heating profile and results of this second simulation are shown in FIG. 2. Specifically, FIG. 2 depicts the rate formation of xylose and XOS, conversion of xylan, release of acetic acid, and formation of furfural for the same hardwood biomass from the first simulation, albeit sized reduced (i.e., modified) to the particle size distribution for "small chips" shown in FIG. 3. The yield of xylose and XOS in this simulation is about 41.3%, as defined elsewhere herein, and the xylan conversion is about 78.5%. FIG. 2 shows the amount of xylose, XOS, acetic acid, and furfural contained within the pores of the biomass ("Entrapped") and free in the bulk extraction liquor ("Free").

As shown in FIG. 1, there is a concentration difference between the pores and the liquor for all of the depicted species, the higher concentration being within the pores of the biomass. This is likely due to the species being produced within the pores faster than the species can diffuse out into the surrounding liquor, and/or the biomass particle size is sufficiently large that some proportion of the produced species are "trapped" within the particle and cannot diffuse out, at least within the time period shown. By comparison, the results shown in FIG. 2 for the smaller particle size biomass demonstrate that there is little to no concentration difference between the pores and liquor for all of the depicted species. This is likely due to the small particle size, which allows the species to freely diffuse in and out of the particles, thereby equalizing the concentrations.

Several additional observations can be made with reference to FIGS. 1 and 2. The larger size biomass (FIG. 1) has a larger XOS concentration left in the biomass particle compared to the smaller size biomass (FIG. 2). The concentration of XOS in both simulations has peaked at around 35 minutes. At the end of the hydrolysis (at 40 minutes) for the larger biomass (FIG. 1), xylose and XOS have been formed in concentrations of about 11 g/L and about 50 g/L, respectively, in the bulk liquor, whereas for the smaller biomass the same species are formed in the bulk liquor in amounts of about 15 g/L and about 62 g/L (FIG. 2).

These results demonstrate that the hydrolysis of two batches of a given biomass differing in particle size distribution (e.g., large vs. small particles) produces various species (e.g., sugars, acetic acid, and degradation products) at different apparent rates and different apparent rates of conversion, as measured with reference to a given species in the bulk liquor. Moreover, these results demonstrate that for larger size biomass, a significant amount of the various species remain "trapped" within the pores of the biomass particle, whereas for sufficiently small size biomass at least some of the various species in the free liquor and in the pores are in equilibrium and therefore the concentrations of these species are equalized.

Example 2

This example is a theoretical simulation that demonstrates the effect of biomass particle/chip size on the rate of xylose and xylo-oligosaccharide (XOS) formation, xylan conversion, release of acetic acid, and formation of furfural, for a biomass that has a slower intrinsic rate of xylan hydrolysis compared to the biomass of Example 1. The simulation is performed the same as in Example 1.

Figure 4:
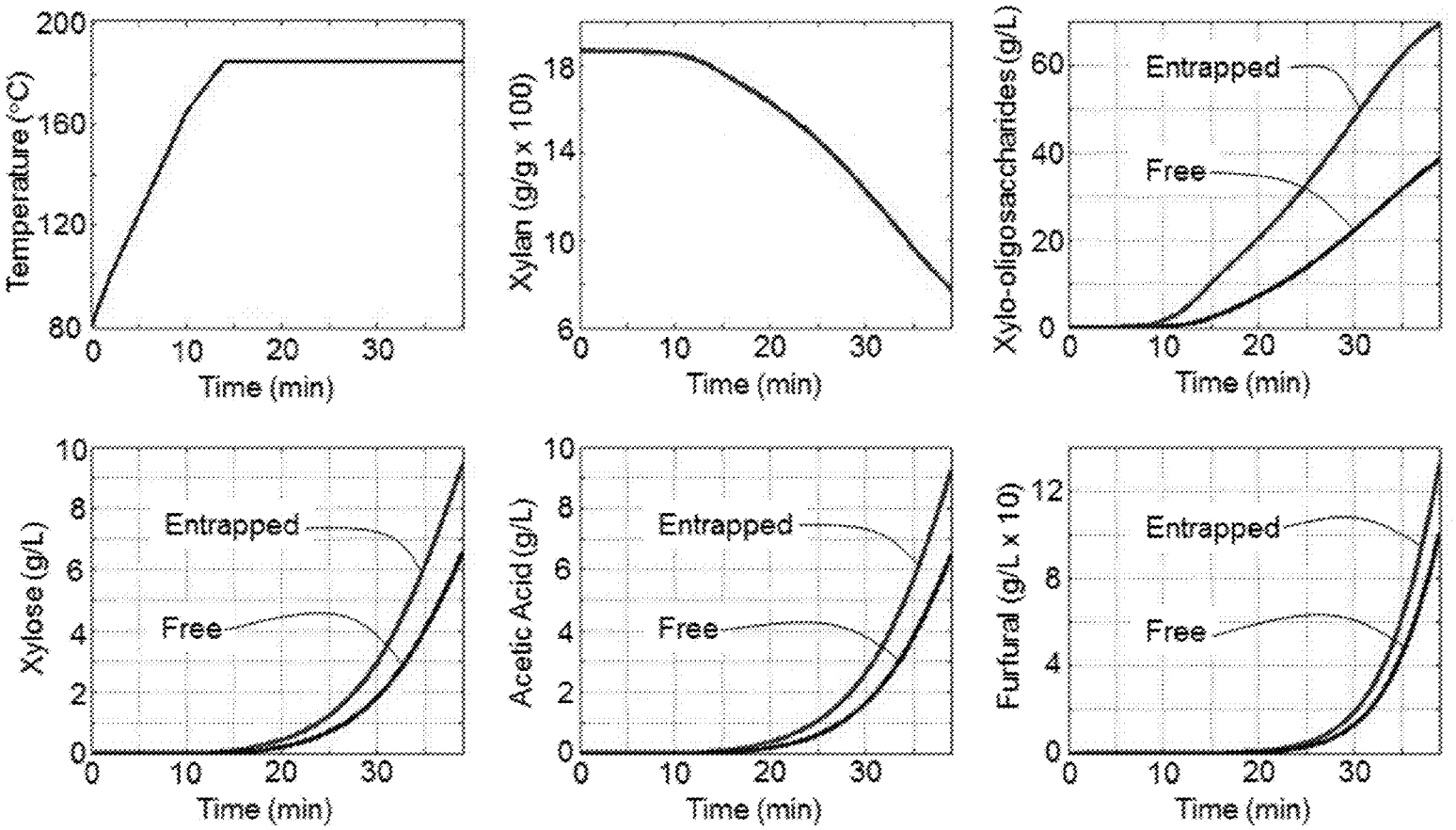
FIG. 4 shows the simulated results of a biomass hydrolysis experiment in Example 2.
Figure 5:
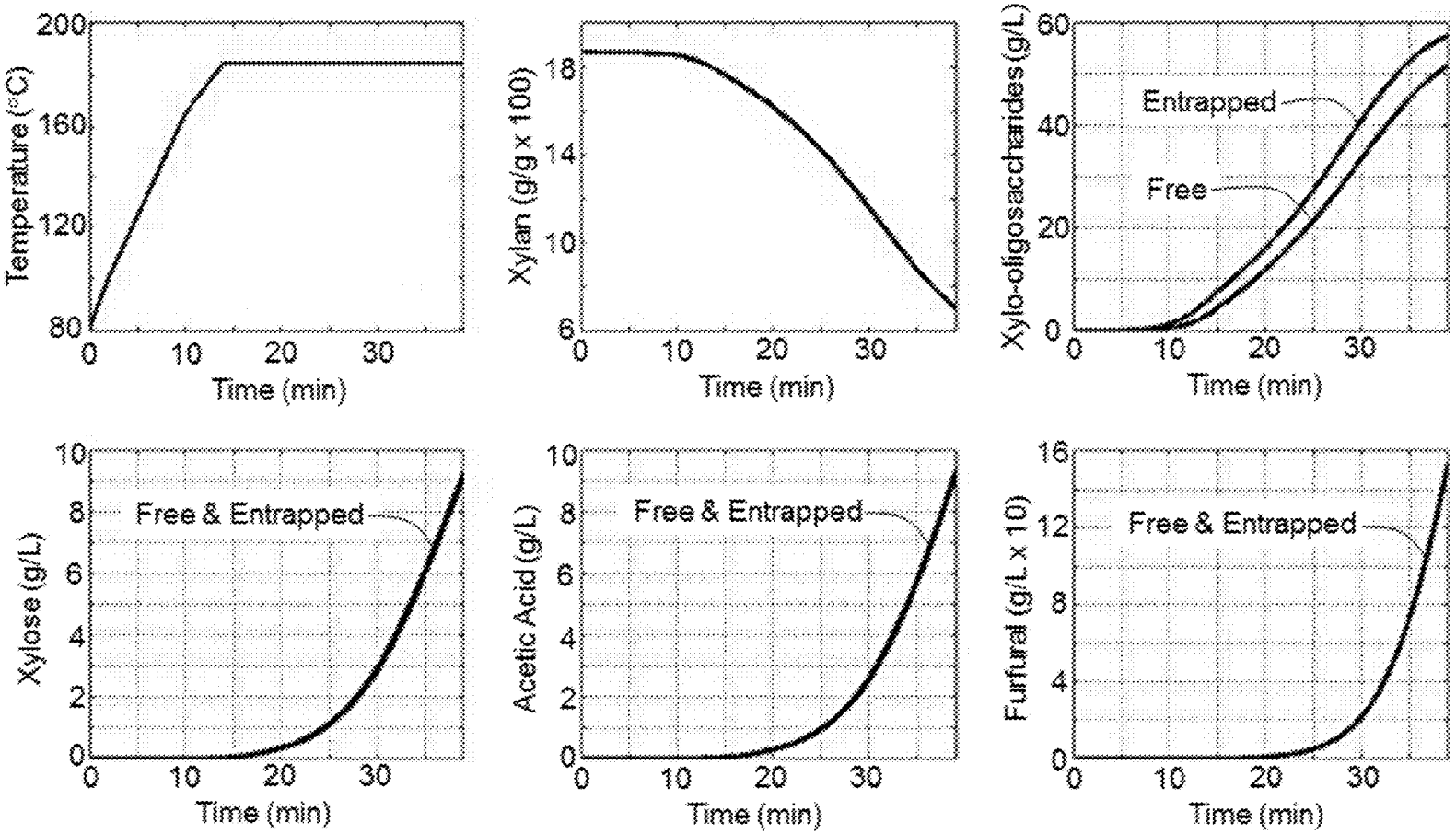
FIG. 5 shows the simulated results of a second biomass hydrolysis experiment in Example 2.

The two simulations in this example utilize the same input parameters as in Example 1 (e.g., biomass amount, moisture content, water amount, liquid-to-solid ratio, etc.), except the intrinsic rate of xylan hydrolysis for the biomass in this example is lower than the intrinsic xylan hydrolysis of the biomass employed in Example 1. The actual hydrolysis rates employed in the simulations for Examples 1 and 2 are not particularly important, but rather the simulations simply seek to demonstrate, for example, the differences in the formation of xylose, XOS, furfural, etc. due to a faster (Example 1) or slower (Example 2) intrinsic xylan hydrolysis rate for a biomass. The results of the simulations in this example are shown in FIGS. 4 and 5. The simulation shown in FIG. 4 utilizes the particle size distribution for the "large chips" shown in FIG. 3 and tabulated in Table 1, whereas the simulation shown in FIG. 5 utilizes the particle size distribution for the "small chips" shown in FIG. 3 and tabulated in Table 2. The xylose and XOS yield for the simulation in FIG. 4 is about 24% and the xylan conversion is about 58%. The xylose and XOS yield for the simulation in FIG. 5 is about 32% and the xylan conversion is about 62%.

FIG. 4 show that for the larger biomass chips there is a difference in concentration between the species contained within the pores ("Entrapped") and the species in the free bulk liquor ("Free"). For the smaller biomass chips (FIG. 5), the "Free" and "Entrapped" amounts are about the same for each of xylose, acetic acid, and furfural, while there is a small difference between "Free" and "Entrapped" amounts for XOS. A comparison of FIG. 1 and FIG. 4, which employs biomass having the same particle size distribution but with different intrinsic hydrolysis rates, reveals that the total amount of each species is lower for the slower hydrolyzing biomass (FIG. 4). The same conclusion can be drawn from a comparison of FIG. 2 and FIG. 5. In other words, the biomass of Example 1 will reach a maximum hydrolysis yield for xylose and XOS at a different time than the biomass of Example 2. Moreover, the total amount of furfural produced at the time of maximum xylose and XOS yield will also be different.

This example demonstrates that for a slower hydrolyzing biomass, a modification (e.g., size reduction) of the biomass can change the distribution of species present in the pores ("Entrapped") and in the bulk liquor ("Free"). Moreover, a comparison of this example with Example 1 demonstrates that biomasses with different intrinsic xylan hydrolysis rates reach maximum yields at different times.

Example 3

This example employs simulated data that demonstrates that two different biomasses having different intrinsic rates of xylan hydrolysis can be modified to result in apparent xylan hydrolysis rates that are similar.

Figure 6:
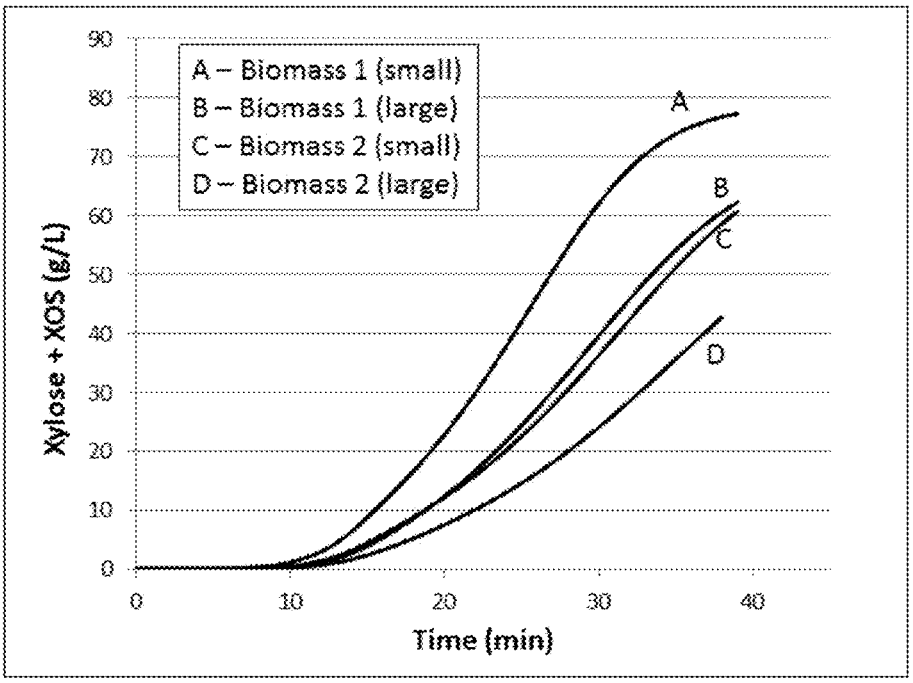
FIG. 6 shows a plot of the simulated total xylose concentration from the biomass hydrolysis experiments of Examples 1 and 2.

FIG. 6 is a plot of the sum of xylose and XOS from the simulations shown in FIG. 1, FIG. 2, FIG. 4, and FIG. 5 from Examples 1 and 2. Curve A is the sum of xylose+XOS from FIG. 2 in Example 1 (i.e., Biomass 1 modified to a "small" size), Curve B is the sum of xylose+XOS from FIG. 1 in Example 1 (i.e., Biomass 1 modified to a "large" size), Curve C is the sum of xylose+XOS from FIG. 5 in Example 2 (i.e., Biomass 2 modified to a "small" size), and Curve D is the sum of xylose+XOS from FIG. 4 in Example 2 (i.e., Biomass 2 modified to a "large" size). As shown in FIG. 6, Curves B and C track one another quite closely, and therefore it is hypothesized that a mixture of Biomass 1 ("large") and Biomass 2 ("small") may hydrolyze at similar rates and therefore produce maximum yields of xylose and XOS at similar times, thereby avoiding the production of significant amounts of degradation products that may form when the apparent hydrolysis rates are comparatively more different.

Example 4

This example provides experimental data showing total xylose yields for two different biomasses that are hydrolyzed separately, and that also are hydrolyzed as a mixture.

Figure 8:
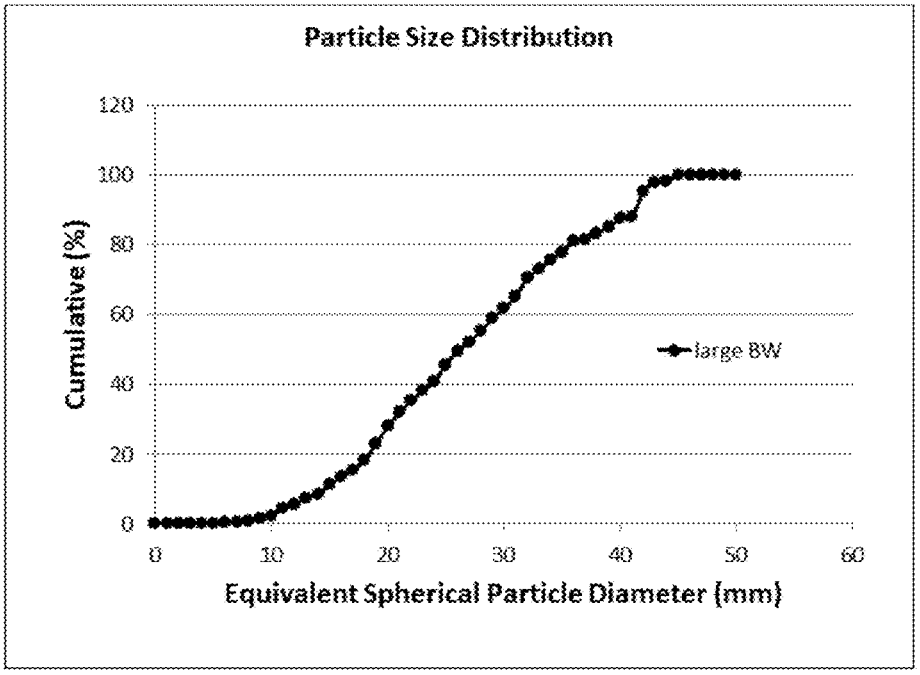
FIG. 8 shows the particle size distribution of the "large BW" biomass of Examples 4, 5, and 7.
Figure 9:
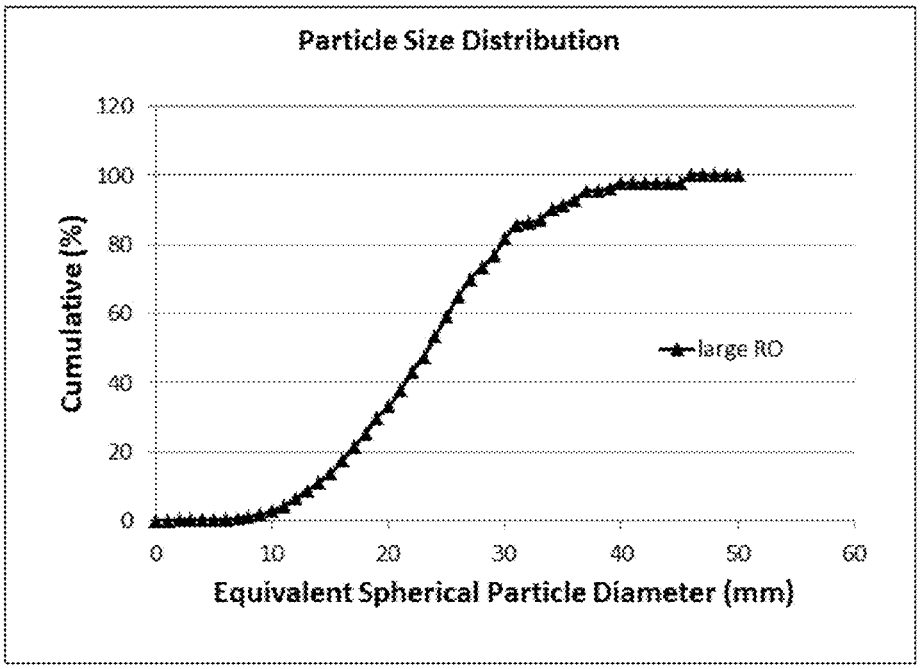
FIG. 9 shows the particle size distribution of the "large RO" biomass of Examples 4, 6, and 7.

This example utilizes "large" basswood ("BW") and "large" red oak ("RO") biomasses having the particle size distributions shown in FIG. 8 and FIG. 9, respectively. Woodchips were produced from logs harvested in Minnesota. The size distribution of the woodchips was performed using contrast imaging on a CAMSIZER unit available from Horiba Scientific. Hot water extractions were performed using an M/K Dual Digester unit. About 400 grams of woodchips or mixtures thereof were loaded into the reactor and water added until a liquid to bone-dry solid ratio of about 12.5 was achieved. The woodchip and water mixture was heated to about 165° C. at a rate of about 4° C./min, and hot water extraction was performed at about 165° C. for about 180 min at this temperature. Liquid samples were taken at selected times and analyzed. After the run time was complete, the reactor was cooled down and liquor was flushed out of reactor and collected. The drained solids were removed, dried, milled and sent for full compositional analysis. Liquid samples were hydrolyzed to monomer to be analyzed for total sugar content (e.g., total xylose). The hydrolysates were analyzed with high performance anion exchange chromatography with electrochemical detector (DIONEX available from Thermo Scientific).

Figure 7:
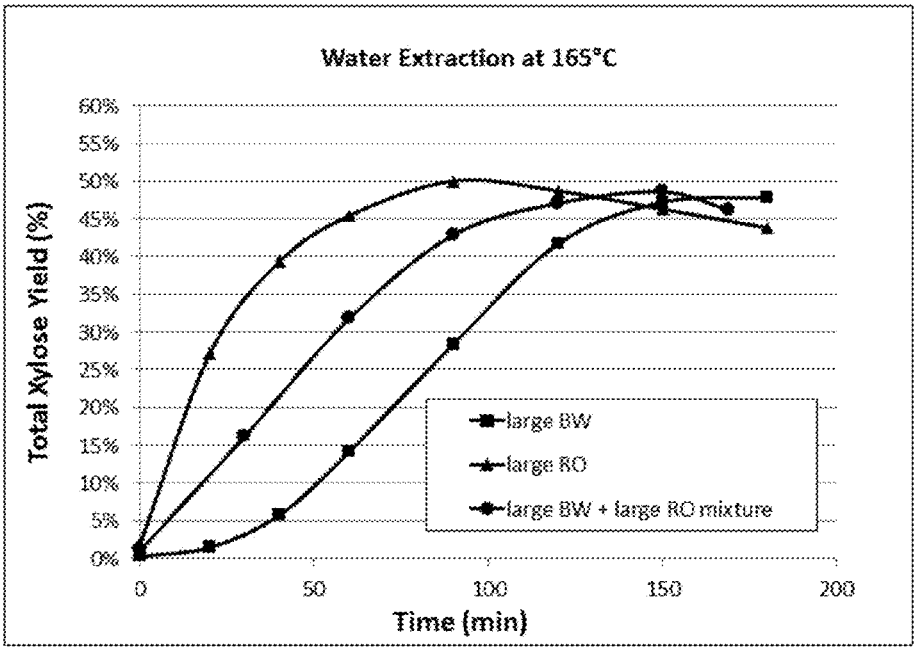
FIG. 7 shows the experimental results of biomass hydrolysis experiments in Example 4.

As shown in FIG. 7, the maximum total hydrolysis yield is about 48% at about 180 min for large BW alone (i.e., time Y), about 50% at about 90 min (i.e., time X) for large RO alone, and about 49% in about 150 min (i.e., time Z) for a 50/50 wt. % mixture of large BW and large RO. Time zero in the measurement of time X, time Y, and time Z is when the mixture reached the temperature for the hydrolysis/extraction (about 165° C.), and times X, Y, and Z do not include the time period required to ramp the temperature up to the hydrolysis/extraction temperature. The curve of total xylose yield over time for the mixture of large BW and large RO falls somewhere in between the curves for BW alone and RO alone. RO achieves a higher total xylose yield in a shorter amount of time, as shown in FIG. 7, and therefore RO has a faster apparent rate of xylan hydrolysis than BW. The total xylose concentration and total xylose yield over time is shown in Table 3. The pH of the mixture of large RO and large BW as a function of time is shown in Table 7 in Example 7.

TABLE 3

Total xylose concentration and total xylose yield as a function of time for Example 4.

| | "Large RO" | | "Large BW" | | Mixture of "Large RO" and "Large BW" | |
|---|---|---|---|---|---|---|
| Time (min) | Total Xylose (g/L) | Yield (%) | Total Xylose (g/L) | Yield (%) | Total Xylose (g/L) | Yield (%) |
| 0 | 0.48 | 2 | 0.04 | 0 | 0.19 | 1 |
| 20 | 6.58 | 27 | 0.23 | 1 | ND | ND |
| 30 | ND | ND | ND | ND | 2.95 | 16 |
| 40 | 9.64 | 39 | 0.90 | 6 | ND | ND |
| 60 | 11.28 | 45 | 2.24 | 14 | 5.89 | 32 |
| 90 | 12.61 | 50 | 4.57 | 28 | 8.06 | 43 |
| 120 | 14.44 | 49 | 6.78 | 42 | 8.96 | 47 |
| 150 | 12.08 | 46 | 7.77 | 47 | 9.36 | 49 |
| 169 | ND | ND | ND | ND | 9.05 | 46 |
| 180 | 11.61 | 44 | 7.99 | 48 | ND | ND |

ND: not determined

Figure 10:
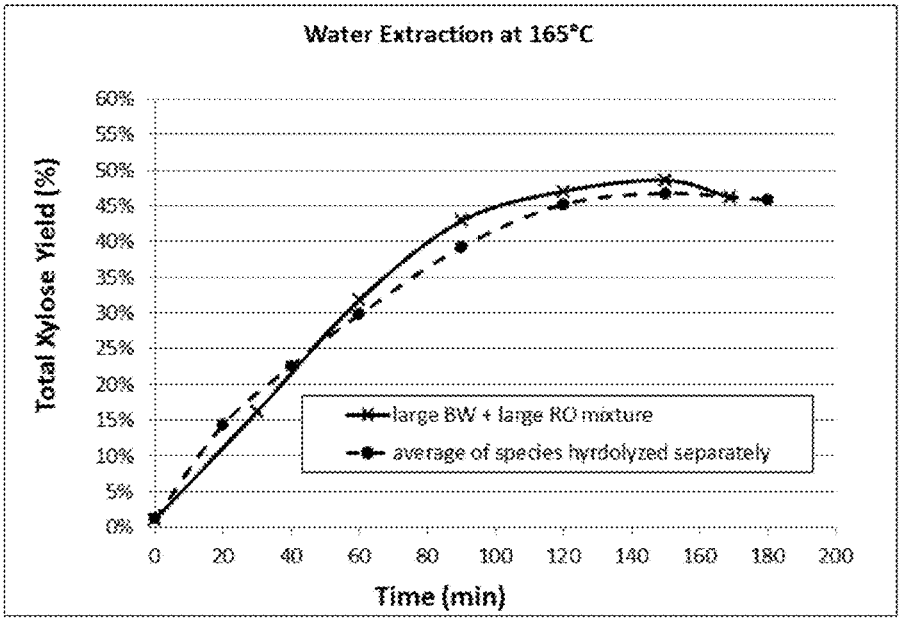
FIG. 10 shows a comparison of experimental and averaged data for biomass hydrolysis experiments in Example 4.

FIG. 10 compares the total xylose yield over time for the mixture of "large RO" and "large BW" with a curve generated by averaging the total xylose yields for "large RO" and "large BW" hydrolyzed separately. The data is presented in tabular form below in Table 4. Surprisingly, for the time period greater than about 50 min, the total hydrolysis yield for the mixture of large BW and large RO is higher than that predicted by averaging the total xylose yields from hydrolyzing large BW and large RO separately.

TABLE 4

Total xylose yield over time for the data presented in FIG. 10 for Example 4.

| | Total Xylose Yield (%) | |
|---|---|---|
| Time (min) | Mixture of "Large RO" and "Large BW" | Average of "Large RO" and "Large BW" Hydrolyzed Separately |
| 0 | 1 | 1 |
| 20 | ND | 14 |
| 30 | 16 | ND |
| 40 | ND | 23 |
| 60 | 32 | 30 |
| 90 | 43 | 39 |
| 120 | 47 | 45 |
| 150 | 49 | 47 |
| 169 | 46 | ND |
| 180 | ND | 46 |

ND: not determined

Example 5

This example provides experimental data demonstrating the effect of biomass particle/chip size on the yield of total xylose from basswood (BW) biomass.

The "large BW" hydrolysis data in this example is the same as that presented in Example 4. The "small BW" biomass was produced by grinding the "large BW" woodchips using a RETSCH Cutting Mill SM 300 with a 4 mm screen. The Milled material was then sieved using a 0.84 mm screen, such that the "small BW" used in the experiments is between 0.84 mm and 4 mm. The experimental procedure for the hot water extraction is the same as that described in Example 4.

Figure 11:
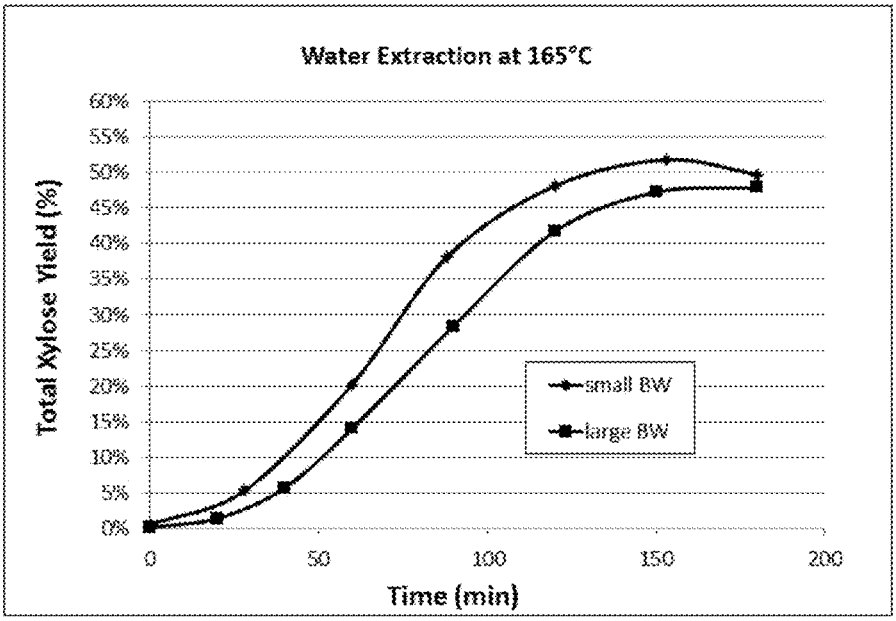
FIG. 11 shows the total xylose yield as a function of time for a biomass that has been modified to different sizes.

FIG. 11 is a comparison of the total xylose yield over time for the hydrolysis of "large BW" and "small BW." It can be seen that the total xylose yield over time is lower for "large BW" than for "small BW." Moreover, a maximum total xylose yield of about 52% is achieved for "small BW" in about 153 min, whereas "large BW" has achieved or will achieve a maximum total xylose yield at a time of >180 min. The total xylose concentration and total xylose yield over time is shown in Table 5.

TABLE 5

Total xylose concentration and total xylose yield as a function of time for Example 5.

| | "Small BW" | | "Large BW" | |
|---|---|---|---|---|
| Time (min) | Total Xylose (g/L) | Yield (%) | Total Xylose (g/L) | Yield (%) |
| 0 | 0.09 | 1 | 0.04 | 0 |
| 20 | ND | ND | 0.23 | 1 |
| 28 | 0.84 | 5 | ND | ND |
| 40 | ND | ND | 0.90 | 6 |
| 60 | 3.35 | 20 | 2.24 | 14 |
| 88 | 6.56 | 38 | ND | ND |
| 90 | ND | ND | 4.57 | 28 |
| 120 | 8.71 | 48 | 6.78 | 42 |
| 150 | ND | ND | 7.77 | 47 |
| 153 | 9.88 | 52 | ND | ND |
| 180 | 10.05 | 50 | 7.99 | 48 |

ND: not determined

Example 6

This example provides experimental data showing total xylose yields for two different biomasses that are hydrolyzed separately, and that also are hydrolyzed as a mixture.

The experimental data for the hydrolyses of "large RO" and "small BW" in this example is the same as that reported in Examples 4 and 5, respectively This example also sets forth experimental data for a 50/50 wt. % mixture of the "large RO" and "small BW" biomasses employed in Examples 4 and 5. The hydrolysis of the mixture of "large RO" and "small BW" employs the same extraction procedure set forth in Example 4.

Figure 12:
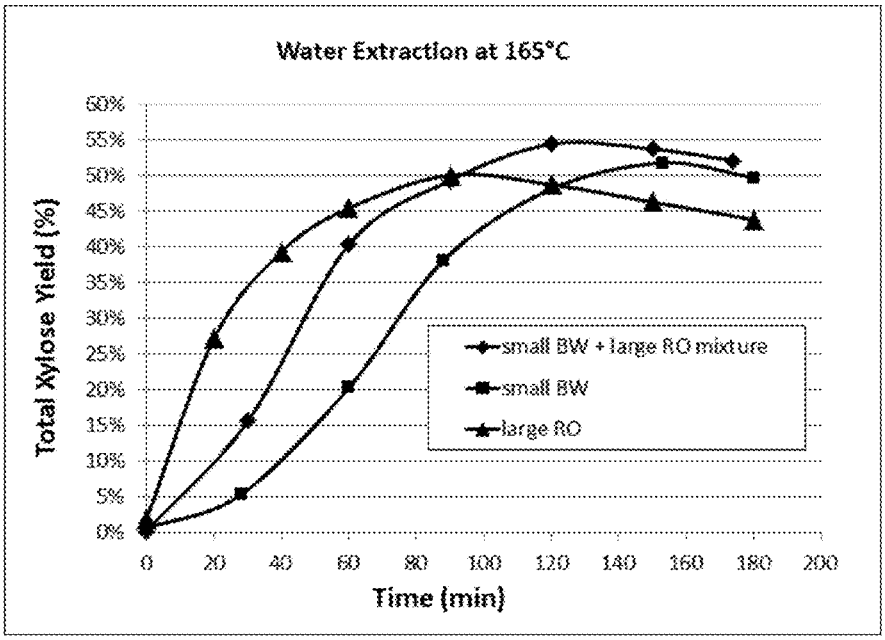
FIG. 12 shows the experimental results of biomass hydrolysis experiments in Example 6.

As shown in FIG. 12, the maximum total xylose yield is about 52% at about 153 min (i.e., time Y) for "small BW" alone, about 50% at about 90 min (i.e., time X) for "large RO" alone, and about 54% in about 120 min (i.e., time Z) for the 50/50 wt. % mixture of "small BW" and "large RO." Time zero in the measurement of time X, time Y, and time Z is when the mixture reached the temperature for the hydrolysis/extraction (about 165° C.), and times X, Y, and Z do not include the time period required to ramp the temperature up to the hydrolysis/extraction temperature. The curve of total xylose yield over time for the mixture of small BW and large RO falls somewhere in between the curves for small BW alone and large RO alone at shorter hydrolysis times, but ultimately and surprisingly achieves a higher maximum total xylose yield than either of the biomasses hydrolyzed separately. Moreover, the time to maximum hydrolysis yield for the mixture is shorter than that for "small BW" hydrolyzed separately. The total xylose concentration and total xylose yield over time for the mixture of "small BW" and "large RO" is shown in Table 6. The data for the separate hydrolyses of "large RO" and "small BW" is already reported in Tables 3 and 5 in Examples 4 and 5, respectively. The pH of the mixture of small BW and large RO as a function of time is shown in Table 8 in Example 7.

TABLE 6

Total xylose concentration and total xylose yield as a function of time for Example 6

| | Mixture of "Small BW" and "Large RO" | |
|---|---|---|
| Time (min) | Total Xylose (g/L) | Yield (%) |
| 0 | 0.05 | 0.3 |
| 30 | 2.81 | 15.6 |
| 60 | 7.41 | 40.4 |
| 90 | 9.28 | 49.3 |
| 120 | 10.4 | 54.4 |
| 150 | 10.6 | 53.7 |
| 174 | 10.5 | 52.1 |

Figure 13:
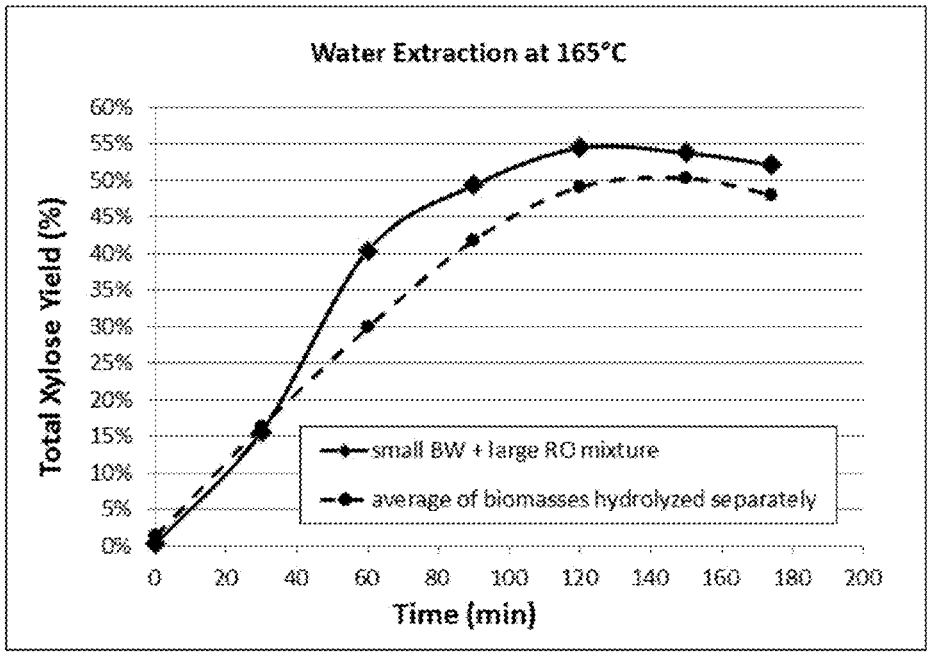
FIG. 13 shows a comparison of experimental and averaged data for biomass hydrolysis experiments in Example 6.

FIG. 13 compares the total xylose yield over time for the mixture of "small BW" and "large RO" with a curve generated by averaging the total xylose yields for "small BW" and "large RO" hydrolyzed separately. As shown in the FIG. 13, from 0 min to about 30 min the total xylose yield of the mixture is roughly similar to the average of the biomasses hydrolyzed separately. Surprisingly, however, in the time period ≥ about 30 min the total hydrolysis yield for the mixture of "small BW" and "large RO" is markedly higher than that predicted by averaging the total xylose yields from hydrolyzing the biomasses separately. In other words, by modifying basswood to produce "small BW" and modifying red oak to produce "large RO," a mixture of these two biomasses can be hydrolyzed together and an unexpected positive synergy achieved.

Example 7

This example provides experimental data demonstrating the amount of furfural produced during the hydrolysis of biomasses separately and in mixtures.

Furfural is a fermentation inhibitor typically formed in biomass hydrolysate via the dehydration of monomeric xylose. Furfural typically needs to be removed from a biomass hydrolysate prior to fermentation, otherwise the xylose or other sugars may not be efficiently fermented. Therefore, the less furfural produced during biomass hydrolysis, the less effort and expense required to removal furfural from the biomass hydrolysate prior to fermentation.

The concentrations of furfural, acetic acid, and formic acid, as well as the pH, were measured for the hydrolyses of the mixture of "large BW" and "large RO," and the mixture of "small BW" and "large RO," performed in Examples 4 and 6, respectively. Furfural was quantified with high performance liquid chromatography (HPLC) with a refractive index detector. The data is reported in Tables 7 and 8. Moreover, the furfural concentration was measured for the separate hydrolyses of "large RO" and "small BW" performed in Examples 4 and 5, respectively. The data is reported in Table 9.

TABLE 7

Furfural, acetic acid, and formic acid concentration, and furfural yield, as a function of time for hydrolysis of a mixture of "large BW" and "large RO."

| Time, min | Acetic Acid, g/L | Formic acid, g/L | pH | Furfural, g/L | Furfural yield, % |
|---|---|---|---|---|---|
| 0 | 0.2 | 0.10 | 4.1 | 0.00 | 0.0 |
| 30 | 0.6 | 0.40 | 3.7 | 0.00 | 0.0 |
| 60 | 1.1 | 0.46 | 3.5 | 0.13 | 0.7 |
| 90 | 1.7 | 0.40 | 3.4 | 0.20 | 1.0 |
| 120 | 2.6 | 0.65 | 3.4 | 0.64 | 3.4 |
| 150 | 3.2 | 0.67 | 3.4 | 0.97 | 5.0 |
| 169 | 3.5 | 0.67 | 3.3 | 1.25 | 6.4 |

TABLE 8

F Furfural, acetic acid, and formic acid concentration, and furfural yield, as a function of time for hydrolysis of a mixture of "small BW" and "large RO."

| Time, min | Acetic Acid, g/L | Formic acid, g/L | pH | Furfural, g/L | Furfural yield, % |
|---|---|---|---|---|---|
| 0 | 0.0 | 0.10 | 4.5 | 0.00 | 0.0 |
| 30 | 0.6 | 0.35 | 3.7 | 0.00 | 0.0 |
| 60 | 1.4 | 0.56 | 3.5 | 0.15 | 0.8 |
| 90 | 1.9 | 0.57 | 3.4 | 0.25 | 1.3 |
| 120 | 2.6 | 0.65 | 3.4 | 0.50 | 2.6 |
| 150 | 3.2 | 0.72 | 3.3 | 0.89 | 4.5 |
| 174 | 3.6 | 0.73 | 3.3 | 1.11 | 5.5 |

TABLE 9

Furfural concentration as a function of time for the separate hydrolyses of the "large RO" and "small BW" from Examples 4 and 5, respectively.

| Time (min) | "Small BW" Furfural (g/L) | "Large RO" Furfural (g/L) |
|---|---|---|
| 0 | 0 | 0 |
| 20 | ND | 0.06 |
| 28 | 0.04 | ND |
| 40 | ND | 0.23 |
| 60 | 0.09 | 0.39 |
| 88 | 0.21 | ND |
| 90 | ND | 0.88 |
| 120 | 0.39 | 1.33 |
| 150 | ND | 1.81 |
| 153 | 0.61 | ND |
| 180 | 0.92 | 2.31 |

ND: not determined

Figure 14:
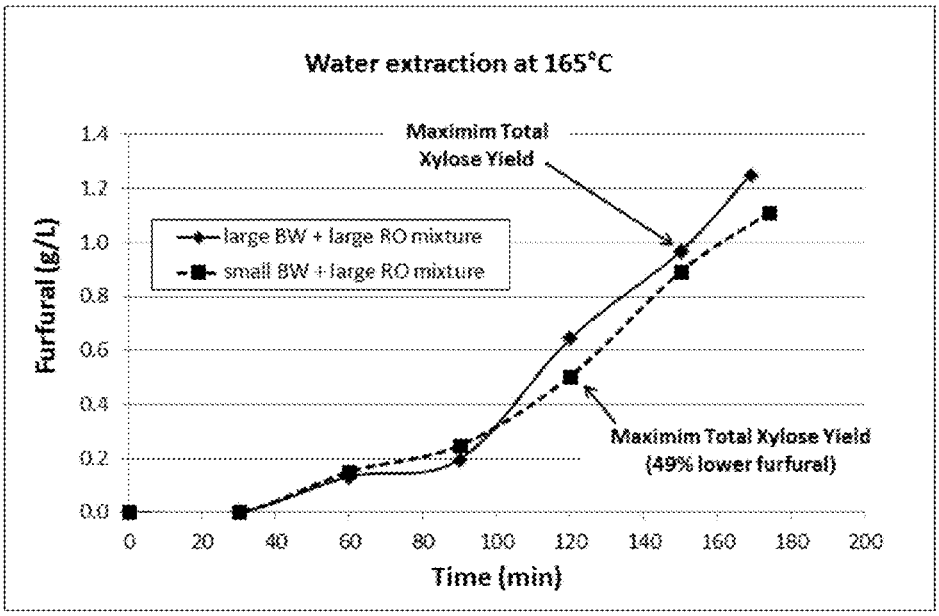
FIG. 14 shows furfural concentration as a function of time for biomass hydrolysis experiments in Example 7.
Figure 15:
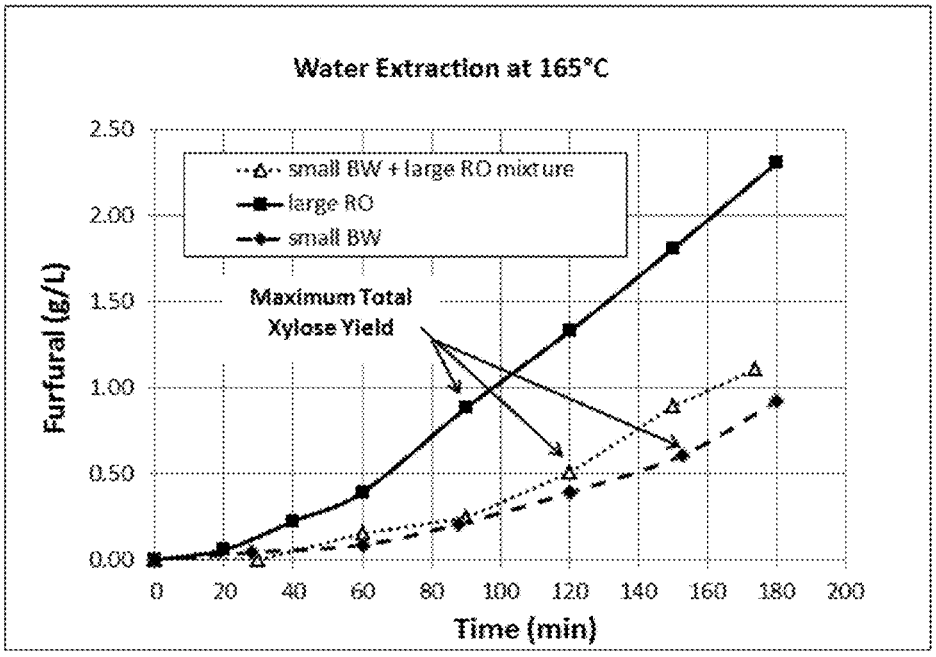
FIG. 15 shows furfural concentration as a function of time for other biomass hydrolysis experiments in Example 7.

FIG. 14 shows the furfural concentration as a function of time for a mixture of "large BW" and "large RO," and also for a mixture of "small BW" and "large RO." The mixture of "small BW" and "large RO" produces about 49% less than that for the mixture of "large BW" and "large RO," when compared at the maximum total xylose yields. FIG. 15 compares furfural concentration as a function of time for the mixture of "small BW" and "large RO" with the furfural concentration over time when separately hydrolyzing "small BW" and "large RO." It is apparent that the hydrolysis of the mixture of "small BW" and "large RO" produces a lower amount of furfural than when separately hydrolyzing "small BW" or "large RO," when compared at the maximum total xylose yields.

This example demonstrates that the xylose dehydration (i.e., furfural formation) can be decreased during extraction by appropriately modifying (e.g., size reducing to an appropriate size) the biomass feedstocks and hydrolyzing as a mixture.

While the preferred forms of the invention have been disclosed, it will be apparent to those skilled in the art that various changes and modifications may be made that will achieve some of the advantages of the invention without departing from the spirit and scope of the invention. Therefore, the scope of the invention is to be determined solely by the claims to be appended.

When ranges are used herein for physical properties, such as temperature ranges and pressure ranges, or chemical properties, such as chemical formulae, all combinations, and subcombinations of ranges specific embodiments therein are intended to be included.

The disclosures of each patent, patent application, and publication cited or described in this document are hereby incorporated herein by reference, in their entirety.

Those skilled in the art will appreciate that numerous changes and modifications can be made to the preferred embodiments of the invention and that such changes and modifications can be made without departing from the spirit of the invention. It is, therefore, intended that the appended claims cover all such equivalent variations as fall within the true spirit and scope of the invention.

What is claimed is:

1. A hydrolysis method comprising:

(1) providing at least two modified biomass feedstocks comprising:

(a) from greater than 0 wt % to less than 100 wt % of a first modified biomass feedstock exhibiting a maximum hydrolysis yield at time X, when subjected to a first condition; and (b) from greater than 0 wt % to less than 100 wt % of a second modified biomass feedstock exhibiting a maximum hydrolysis yield at time Y, when subjected to the first condition;

wherein:

the second modified biomass feedstock is different from the first modified biomass feedstock;

time X is less than or equal to time Y;

and time X and time Y differ by less than or equal to about 100% of time X; and (2) subjecting a mixture of the first modified biomass feedstock and the second modified biomass feedstock to the first condition to achieve a maximum hydrolysis yield at time Z, wherein time Z is less than time Y;

wherein:

the hydrolysis method is performed at a pH of at least 1.3; and all weight percent values are on a dry basis and are based on the total weight of the at least two modified biomass feedstocks.

2. The method of claim 1, wherein the second modified biomass feedstock is different from the first modified biomass feedstock by a difference selected from the group consisting of compositional proportions, biomass type, biomass species, hemicellulose structure, geographical harvesting location, harvesting season, and any combination thereof.

3. The method of claim 2, wherein the difference is biomass type, and the biomass type of the first and second modified biomass feedstocks is independently selected from the group consisting of a softwood biomass, a hardwood biomass, a tropical wood biomass, an annual fiber biomass, a non-woody biomass, municipal solid waste, and any combination thereof.

4. The method of claim 1, wherein the hydrolysis method is performed at a pH of at least about 2.

5. The method of claim 1, wherein (a) the first modified biomass feedstock is prepared by a first treatment; and (b) the second modified biomass feedstock is prepared by a second treatment;

wherein the first and second treatments independently are selected from the group consisting of size reduction, steam explosion, ammonia explosion, enzymatic treatment, acid treatment, base treatment, hydrothermal treatment, biological treatment, catalytic treatment, non-catalytic treatment, and any combination thereof; and wherein the first treatment is the same or different than the second treatment.

6. The method of claim 5, wherein at least one of the first and the second treatments is size reduction, and wherein the average equivalent spherical diameter of at least one of the first and second modified biomass feedstocks is less than about 50 mm.

7. The method of claim 5, wherein both the first treatment and the second treatment are size reduction, the second modified biomass feedstock has a particle size of less than about 50 mm, and the average equivalent spherical diameter of the second modified biomass feedstock is smaller than the average equivalent spherical diameter of the first modified biomass feedstock.

8. The method of claim 5, wherein the first and the second treatment are size reduction, and wherein the second modified biomass feedstock has an average equivalent spherical diameter of less than about 80% of an average equivalent spherical diameter of the first modified biomass feedstock.

9. The method of claim 1, wherein the first modified biomass feedstock and the second modified biomass feedstock are in the mixture in a weight ratio of from about 1:25 to about 25:1.

10. The method of claim 1, wherein the first condition is hot water extraction, acidic hot water extraction, sub-critical fluid extraction, near-critical fluid extraction, supercritical fluid extraction, enzymatic treatment, or any combination.

11. The method of claim 10, wherein the first condition is hot water extraction.

12. The method of claim 11, wherein the hot water extraction is performed at a temperature of about 120° C. to about 260° C.

13. The method of claim 11, wherein the hot water extraction employs hot water, and the hot water extraction is performed at a pressure sufficient to maintain all of the hot water in liquid form.

14. The method of claim 1, wherein time Z is less than about 90% of time Y.

15. The method of claim 1, wherein the maximum hydrolysis yield at time Z achieved in the subjecting the mixture to the first condition is higher than an average of the maximum hydrolysis yields at times X and Y.

16. The method of claim 15, wherein the maximum hydrolysis yield at time Z achieved in the subjecting the mixture to the first condition is at least about 5% higher than the average of the maximum hydrolysis yields at times X and Y.

17. The method of claim 1, wherein time Z is less than an average of time X and time Y.

18. The method of claim 1, wherein a first degradation yield of a degradation product at time Z achieved in the subjecting the mixture to the first condition is lower than at least one of (1) a second degradation yield of the degradation product of the first modified biomass feedstock at time X, when subjected to the first condition, and (2) a third degradation yield of the degradation product of the second modified biomass feedstock at time Y, when subjected to the first condition.

19. The method of claim 18, wherein the degradation product is furfural.

20. The method of claim 1, further comprising:

preparing the first modified biomass feedstock with a first treatment; and preparing the second modified biomass feedstock with a second treatment;

wherein the first and second treatments independently are selected from the group consisting of size reduction, steam explosion, ammonia explosion, enzymatic treatment, acid treatment, base treatment, hydrothermal treatment, biological treatment, catalytic treatment, non-catalytic treatment, and any combination thereof; and wherein the first treatment is the same or different than the second treatment.

* * * * *